US009079445B2

(12) United States Patent
Yoneyama et al.

(10) Patent No.: US 9,079,445 B2
(45) Date of Patent: Jul. 14, 2015

(54) IMAGE FORMING METHOD AND COMBINATION OF THERMAL TRANSFER SHEET AND THERMAL TRANSFER IMAGE-RECEIVING SHEET

(71) Applicant: DAI NIPPON PRINTING CO., LTD., Tokyo (JP)

(72) Inventors: Yasushi Yoneyama, Tokyo (JP); Yusaku Akiyama, Tokyo (JP); Munenori Ieshige, Tokyo (JP)

(73) Assignee: DAI NIPPON PRINTING CO., LTD., Tokyo (JP)

( * ) Notice: Subject to any disclaimer, the term of this patent is extended or adjusted under 35 U.S.C. 154(b) by 0 days.

(21) Appl. No.: 14/348,615

(22) PCT Filed: Sep. 25, 2012

(86) PCT No.: PCT/JP2012/074528

§ 371 (c)(1),
(2) Date: Mar. 31, 2014

(87) PCT Pub. No.: WO2013/047501

PCT Pub. Date: Apr. 4, 2013

(65) Prior Publication Data

US 2014/0267535 A1 Sep. 18, 2014

(30) Foreign Application Priority Data

Sep. 30, 2011 (JP) ..... 2011-217869
Sep. 30, 2011 (JP) ..... 2011-217873
Sep. 21, 2012 (JP) ..... 2012-208925

(51) Int. Cl.

| | |
|---|---|
| ***B41J 33/14*** | (2006.01) |
| ***B41M 5/395*** | (2006.01) |
| ***B41M 5/382*** | (2006.01) |
| ***B41M 5/44*** | (2006.01) |
| ***B41M 5/52*** | (2006.01) |

(52) U.S. Cl.

CPC ..... *B41M 5/395* (2013.01); *B41M 5/38214* (2013.01); *B41M 5/443* (2013.01); *B41M 5/52* (2013.01); *B41M 2205/02* (2013.01); *B41M 2205/36* (2013.01)

(58) Field of Classification Search

USPC ..... 347/16, 171, 211, 213–215, 217–219; 400/611, 613, 618, 621, 621.1

See application file for complete search history.

(56) References Cited

U.S. PATENT DOCUMENTS

| | | | |
|---|---|---|---|
| 4,840,848 | A | 6/1989 | Koshizuka et al. |
| 4,968,659 | A | 11/1990 | Nishitani |
| 2005/0059550 | A1 | 3/2005 | Foster et al. |
| 2010/0051184 | A1 | 3/2010 | Oguma et al. |

FOREIGN PATENT DOCUMENTS

| | | |
|---|---|---|
| JP | 04-113889 | 4/1992 |
| JP | 07-179064 | 7/1995 |
| JP | 09-234963 | 9/1997 |
| JP | 11-139003 | 5/1999 |
| JP | 2001-058467 | 3/2001 |

OTHER PUBLICATIONS

International Search Report—PCT/JP2012/074528—Dec. 4, 2012.

*Primary Examiner* — Kristal Feggins
(74) *Attorney, Agent, or Firm* — YOUNG & THOMPSON

(57) ABSTRACT

An image forming method and a combination of a thermal transfer sheet and a thermal transfer image receiving sheet are capable of forming images of high print quality. An image forming method wherein an image is formed by combining a thermal transfer sheet, which is obtained by forming a dye layer on one surface of a substrate and forming a back surface layer on the other surface of the substrate, and a thermal transfer image receiving sheet, which is obtained by forming a dye receiving layer on one surface of another substrate. The dye layer of the thermal transfer sheet contains a sublimable dye, a binder resin and one or both of (A) a polyether-modified silicone having a viscosity of not less than 1,000 $mm^2/s$ at 25° C. and (B) a polyester-modified polysiloxane. The dye receiving layer of the thermal transfer image receiving sheet is an aqueous dye receiving layer.

10 Claims, 1 Drawing Sheet

IMAGE FORMING METHOD AND COMBINATION OF THERMAL TRANSFER SHEET AND THERMAL TRANSFER IMAGE-RECEIVING SHEET

TECHNICAL FIELD

This invention relates to an image forming method and a combination of a thermal transfer sheet and a thermal transfer image-receiving sheet.

BACKGROUND ART

Currently, sublimation type thermal transfer recording method is known, wherein a thermal transfer sheet in which a sublimation type dye is supported on a substrate made of a plastic film or the like, and a thermal transfer image-receiving sheet in which a receiving layer is provided on a substrate made of a paper, a plastic film or the like are superposed to form a full color image. Since this method uses the sublimation type dye as a color material, this method excels in reproducibility and gradation of halftone, and thus, a full-color image can be clearly expressed as the original image on the image-receiving sheet. Therefore, this method has been applied in the color image formation for digital cameras, video recorders, computers or the like. Its image can rival silver halide photography with high quality.

As the thermal transfer image-receiving sheet to be used for the sublimation type thermal transfer recording method, a solvent type thermal transfer image-receiving sheet that has a solvent type dye receiving layer of the solvent system, and an aqueous type thermal transfer image-receiving sheet that has an aqueous dye receiving layer are known in the art. The solvent type thermal transfer receiving sheet excels in releasing property as compared with the aqueous type transfer receiving sheet. The solvent type thermal transfer receiving sheet, however, is poor in gloss of an image formed thereon, as compared with an image formed on the aqueous type thermal transfer receiving sheet. Therefore, in the field where high gloss is required for the image to be formed, there is a tendency that the thermal transfer image-receiving sheet of the aqueous type is preferred. Further, in view of problems such as the influence of treatment of waste liquid on the environment, there are increased tendency to use the aqueous type thermal transfer image-receiving sheet.

The aqueous type thermal transfer image-receiving sheet gives no adverse effect on the human body and the environment, and the aqueous type thermal transfer image-receiving sheet has an advantage of being able to impart a high gloss to the image formed thereon as compared with the solvent type thermal transfer image-receiving sheet. On the other hand, an aqueous type receiving layer shows a poor release ability with a dye layer, and thus, there are problems such that aqueous type receiving layer may cause fusion with the dye layer on printing, and a released mark may leave on a printed matter when peeling off the dye layer from the receiving layer, which are followed by a degression in the quality of printing.

Under such circumstances, various attempts for obtaining the thermal transfer sheet having an excellent releasing property to a thermal transfer image-receiving sheet have been made. For instance, in Patent Literature 1, a thermal transfer sheet which comprises a dye layer containing a silicone oil has been disclosed. Further, in Patent Literature 2, a thermal transfer sheet which comprises a dye layer containing a silicone-modified acrylic resin has been disclosed.

However, with respect to the thermal transfer sheet disclosed is in the Patent Literatures 1 and 2, and various thermal transfer sheets known to date, it has been not attained to give an release property which is even enough for a three-dimensional Y, M, and C printing at the highest gray-scale under a high temperature and high humidity environment. Thus, there have been many cases of leaving released marks on the printed matters. In particular, the released mark is likely to occur in the case of using the aqueous type thermal transfer image-receiving sheet.

PRIOR ART DOCUMENT

Patent Literature

Patent Literature 1: JP 7-179064 A
Patent Literature 2: JP 9-234963 A

SUMMARY OF INVENTION

Problem to be Solved by the Invention

The present invention is the one contrived in such a situation, and a main purpose of the present invention is to provide an image forming method where the occurrence of the released mark is prevented even in the case that the printing is done under a high temperature and high humidity environment, or done at a high energy printing, and where an image which excels in printing qualities can be obtained, and also to provide a combination of thermal transfer sheet and thermal transfer image-receiving sheet, which is capable of forming such an image.

Means for Solving the Problem

The present invention for solving the above mentioned problem is an image forming method in which an image is formed by using a thermal transfer sheet and a thermal transfer image-receiving sheet in combination, wherein the thermal transfer sheet comprises a substrate, a dye layer formed on one surface of the substrate and a back face layer formed on another surface of the substrate, wherein the thermal transfer image-receiving sheet comprises another substrate and a dye-receiving layer formed on one surface of the other substrate, which is characterized in that the dye layer of the thermal transfer sheet comprises a sublimation type dye, a binder resin, and one or both of (A) a polyether modified silicone having a viscosity of not less than 1000 $mm^2/s$ at 25° C., and (B) a polyester modified polysiloxane; and the dye-receiving layer of the thermal transfer image-receiving sheet comprises an aqueous dye-receiving layer.

Further, a binder resin which is contained in the dye layer may be a polyvinyl acetal resin or a polyvinyl butyral resin.

Further, selected from (A) the polyether modified silicone having a viscosity of not less than 1000 $mm^2/s$ at 25° C., and (B) the polyester modified polysiloxane, in the case that (A) the polyether modified silicone having a viscosity of not less than 1000 $mm^2/s$ at 25° C. is contained alone in the dye layer, (A) the polyether modified silicone having a viscosity of not less than 1000 $mm^2/s$ at 25° C. may be contained at an amount range of not less than 0.5% by weight and not more than 5% by weight on the basis of the total solid content weight of the binder resin in the dye layer; in the case that (B) the polyester modified polysiloxane is only contained alone in the dye layer, (B) the polyester modified polysiloxane may be contained at an amount range of not less than 0.3% by weight and not more than 8% by weight on the basis of the total solid content weight of the binder resin in the dye layer; and in the case that both (A) the polyether modified silicone having a viscosity of not less than 1000 $mm^2/s$ at 25° C., and (B) the polyester modified polysiloxane are contained in the dye layer, (A) the polyether modified silicone having a viscosity of not less than 1000 $mm^2/s$ at 25° C., and (B) the polyester modified polysiloxane may contained at an total amount thereof of not less than 0.5% by weight and not more than 5% by weight on the basis of the total solid content weight of the binder resin in the dye layer.

Further, the aqueous dye-receiving layer may be a dye-receiving layer containing a water-soluble resin or water-soluble polymer, or a dye-receiving layer formed by using a coating liquid containing an aqueous resin.

Further, the present invention for solving the aforementioned problems is a combination of a thermal transfer sheet and a thermal transfer image-receiving sheet, which is characterized in that the thermal transfer sheet comprises a substrate, a dye layer formed on one surface of the substrate and a back face layer formed on another surface of the substrate, wherein the dye layer comprises a sublimation type dye, a binder resin, and one or both of (A) a polyether modified silicone having a viscosity of not less than 1000 $mm^2/s$ at 25° C., and (B) a polyester modified polysiloxane; and the thermal transfer image-receiving sheet comprises another substrate and a dye-receiving layer formed on one surface of the other substrate.

Effect of the Invention

According to the image forming method of the present invention, or the combination of the thermal transfer sheet and the thermal transfer image-receiving sheet of the present invention, it is possible to form an image which excels in the printing quality, while preventing the occurrence of the released mark on the printed matter, even in the case that the printing is done under a high temperature and high humidity environment, or done at a high energy printing. Further, since the image is formed on the aqueous dye-receiving layer in the present invention, it is possible to obtain an image having a high glossiness.

EMBODIMENTS FOR CARRYING OUT THE INVENTION

Figure 1:
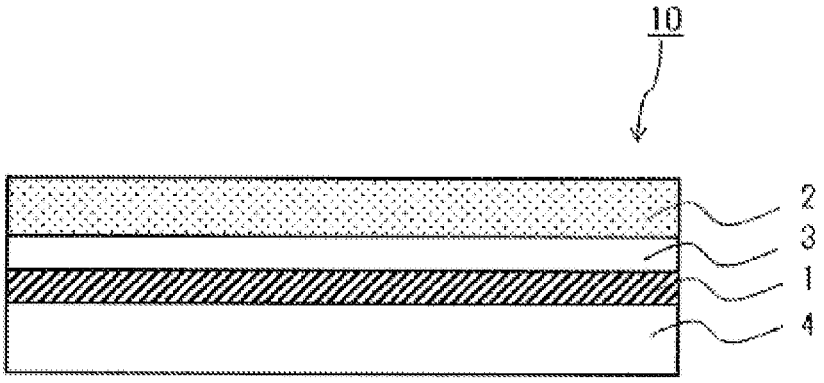
FIG. 1 is a schematic sectional view showing an embodiment of the thermal transfer sheet which is used in the image forming method, and the combination of the thermal transfer sheet and the thermal transfer image-receiving sheet according to the present invention.
Figure 2:
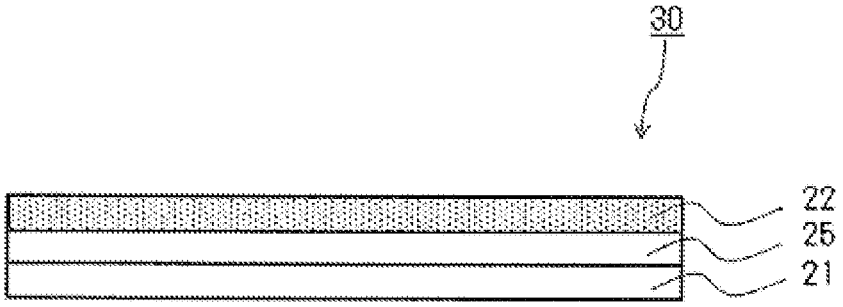
FIG. 2 is a schematic sectional view showing an embodiment of the thermal transfer image-receiving sheet which is used in the image forming method, and the combination of the thermal transfer sheet and the thermal transfer image-receiving sheet according to the present invention.

Hereinafter, the image forming method, and the combination of the thermal transfer sheet and the thermal transfer image-receiving sheet according to the present invention will be described in detail. The image forming method according to the present invention is a method where an image is formed by using a thermal transfer sheet 10 as shown in FIG. 1 and a thermal transfer image-receiving sheet 30 as shown in FIG. 2 in combination, wherein the thermal transfer sheet 10 comprises a substrate 1, a dye layer 2 formed on one surface of the substrate 1 and a back face layer 4 formed on another surface of the substrate 1, wherein the thermal transfer image-receiving sheet 30 comprises another substrate 21 and a dye-receiving layer 22 formed on one surface of the other substrate 21, which is characterized in that the dye layer 2 of the thermal transfer sheet 10 comprises a sublimation type dye, a binder resin, and one or both of (A) a polyether modified silicone having a viscosity of not less than 1000 $mm^2/s$ at 25° C., and (B) a polyester modified polysiloxane; and the dye-receiving layer 22 of the thermal transfer image-receiving sheet 30 comprises an aqueous dye-receiving layer. In addition, the combination according to the present invention is a combination of a thermal transfer sheet and a thermal transfer image-receiving sheet, which is characterized in that the thermal transfer sheet 10 comprises a substrate 1, a dye layer 2 formed on one surface of the substrate 1 and a back face layer 4 formed on another surface of the substrate 1, wherein the dye layer 2 comprises a sublimation type dye, a binder resin, and one or both of (A) a polyether modified silicone having a viscosity of not less than 1000 $mm^2/s$ at 25° C., and (B) a polyester modified polysiloxane; and the thermal transfer image-receiving sheet 30 comprises another substrate 21 and a dye-receiving layer 22 formed on one surface of the other substrate 21.

Hereinafter, the thermal transfer sheet 10 and the thermal transfer image-receiving sheet 30, which are used in the image forming method, and the combination of the thermal transfer sheet and the thermal transfer image-receiving sheet according to the present invention will be described in detail. FIG. 1 is the schematic sectional view showing an embodiment of the thermal transfer sheet which is used in the image forming method, and the combination of the thermal transfer sheet and the thermal transfer image-receiving sheet according to the present invention, and FIG. 2 is the schematic sectional view showing an embodiment of the thermal transfer image-receiving sheet which is used in the image forming method, and the combination of the thermal transfer sheet and the thermal transfer image-receiving sheet according to the present invention.

<<Thermal Transfer Sheet>>

As shown in FIG. 1, the thermal transfer sheet 10 which is used in the image forming method, and the combination of the thermal transfer sheet and the thermal transfer image-receiving sheet according to the present invention takes a structure where a dye layer 2 is formed on one surface of a substrate 1, and a back face layer 3 is formed on another surface of the substrate 1. Here, in the present invention, the dye layer 2 comprises a sublimation type dye, a binder resin, and one or both of (A) a polyether modified silicone having a viscosity of not less than 1000 $mm^2/s$ at 25° C., and (B) a polyester modified polysiloxane. Incidentally, in FIG. 1, an undercoat layer 3 is provided between the substrate 1 and the dye layer 2 of the thermal transfer sheet. It should be noted that, however, the undercoat layer 3 is an optional constituent in the thermal transfer sheet 10 which is used in the image forming method, and the combination of the thermal transfer sheet and the thermal transfer image-receiving sheet according to the present invention.

(Substrate)

As the substrate 1 used for the thermal transfer sheet 10, it is not particularly limited, as far as it is the one which has transparency in addition to a certain heat resistance and a certain strength, and it is possible to select one arbitrarily from materials known in the art. As such a substrate 1, for instance, polyethylene terephthalate film, 1,4-polycyclohexylene dimethylene terephthalate film, polyethylene naphthalate film, polyphenylene sulfide film, polystyrene film, polypropylene film, polysulfone film, aramide film, polycarbonate film, polyvinyl alcohol film, cellulose derivatives such as cellophane and cellulose acetate, polyethylene film, polyvinyl chloride film, nylon film, polyimide film, ionomer film, etc., which have a thickness of about 0.5-50 μm, preferably, about 1-10 μm, can be enumerated. Further, although these materials may be used singly, it is also possible to use a certain material as a layered film in which the material is combined with one or more of other materials.

(Dye Layer)

As shown in FIG. 1, a dye layer 2 is provided on at least a part of the one surface of the substrate 1. In the dye layer 2, one or both of (A) a polyether modified silicone having a viscosity of not less than 1000 $mm^2/s$ at 25° C., and (B) a polyester modified polysiloxane is included, in addition to a sublimation type dye and a binder resin.

<Polyether Modified Silicone>

Polyether-modified silicone contained in the dye layer 2 is one of those as represented by the following general formula (1), where a polyether group is introduced into a side chain of polysiloxane skeleton.

[Chem. 1]

(1)

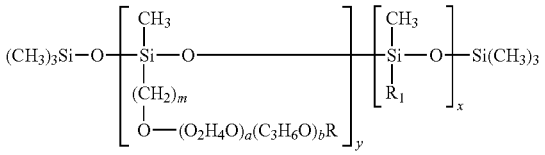

Wherein, R represents H, or a straight- or branched-alkyl group which may be optionally substituted by an aryl group or a cycloalkyl group; $R_1$ represents an alkyl group, or an organic modified group of epoxy or amino group; a, b represent an integer of not more than 100, independently and respectively; and x, y represent an integer, independently and respectively, but are not particular limited.

The polyether modified silicone represented by the above general formula (1) is defined to have a viscosity of not less than 1000 $mm^2/s$ at 25° C. In the present invention, since the polyether modified silicone having a viscosity of not less than 1000 $mm^2/s$ at 25° C. is contained in the dye layer 2, an excellent releasing property to the dye-receiving layer of the thermal transfer image-receiving sheet is given to the dye layer 2. Therefore, according to the image forming method of the present invention for forming an image using a thermal transfer sheet having a dye layer 2 which contains a polyether-modified silicone having a viscosity of not less than 1000 $mm^2/s$ at 25° C., since the releasing property of the dye layer to the aqueous dye-receiving layer is good, it is possible to effectively prevent the occurrence of peeling-off mark, and to form an image with high quality. Further, since the image is formed on the aqueous dye-receiving layer, it is possible to improve the glossiness of the obtained image.

Herein, the viscosity at 25° C. of the polyether modified silicone means the viscosity measured in accordance with the measuring method of JIS Z 8803 (2011).

If a polyether modified silicone having a viscosity of less than 1000 $mm^2/s$ at 25° C. is contained in the dye layer 2, or if a modified silicone resin which has a viscosity of less than 1000 $mm^2/s$ at 25° C., but which is other than the polyether modified silicone and the polyester modified polysiloxane is contained in the dye layer 2, the releasing property cannot be improved sufficiently, and the occurrence of peeling-off mark will arise when forming an image with using an aqueous dye-receiving layer.

There is no especially limitation about the numerical numbers of m, x, y shown in the above general formula (1), and, it is possible to set them appropriately so that the viscosity at 25° C. is in the range of not less than 1000 $mm^2/s$.

There is also no particular limitation about the content of the polyether modified silicone having a viscosity of not less than 1000 $mm^2/s$ at 25° C. In the case that the polyether modified silicone having a viscosity of not less than 1000 $mm^2/s$ at 25° C. is alone contained in the dye layer 2 by selecting from the polyether modified silicone having a viscosity of not less than 1000 $mm^2/s$ at 25° C. and the polyester modified polysiloxane, it is preferable that the polyether modified silicone is contained at an amount range of not less than 0.5% by weight and not more than 5% by weight on the basis of the total solid content weight of the binder resin in the dye layer 2. When it is less than 0.5% by weight on the basis of the total solid content weight of the binder resin in the dye layer 2, there is a tendency that the effect of improving the releasing property is lowered. On the other hand, if it is more than 5% by weight, there are cases where defects such as pinholes are appeared on the coated surface of the dye layer, and the storage stability is reduced so that the dye is precipitated out of the dye layer.

It is not particularly limited for the upper limit of the viscosity at 25° C. of the polyether modified silicone, as long as it is not less than 1000 $mm^2/s$. When the viscosity at 25° C. is more than 100000 $mm^2/s$, however, there is a tendency that the coating compatibility on forming the dye layer becomes worse. Therefore, considering this point, it is preferable that the polyether modified silicone has a viscosity of not more than 100000 $mm^2/s$ at 25° C.

<Polyester Modified Polysiloxane>

The polyester modified polysiloxane is one of those as represented by the following general formula (2), where a polyester group is introduced into a side chain of polysiloxane skeleton.

[Chem. 2]

(2)

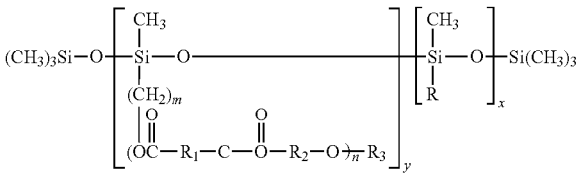

Wherein, R represents an alkyl group; $R_1$, $R_2$ represent an alkylene group or an aryl group, independently and respectively; $R_3$ represents an alkyl group; and m, n, and x, y represent an integer, independently and respectively, but are not particular limited.

As such a polyester modified polysiloxane, for instance, polyester-modified polydimethyl siloxane, polyester-modified poly methyl alkyl polysiloxane, polyester-modified methyl alkyl polysiloxane, and polyester-modified hydroxyl group-containing polydimethyl siloxane, and any structural equivalent thereof, can be enumerated.

In the present invention, since the polyester modified polysiloxane is contained in the dye layer 2, an excellent releasing property to the aqueous dye-receiving layer of the thermal transfer image-receiving sheet is given to the dye layer 2. Therefore, according to the image forming method of the present invention for forming an image using a thermal transfer sheet having a dye layer 2 which contains a polyester modified polysiloxane, since the releasing property of the dye layer to the aqueous dye-receiving layer is good, it is possible to effectively prevent the occurrence of peeling-off mark, and to form an image with high quality. Further, since the image is formed on the aqueous dye-receiving layer, it is possible to improve the glossiness of the obtained image. Furthermore, even when performing the printing of high-energy under high-temperature and high-humidity environment, the releasing property of the dye layer to the aqueous dye-receiving layer is good, so that it is possible to effectively prevent the occurrence of peeling-off mark.

There is also no particular limitation about the content of the polyester modified polysiloxane. In the case that the polyester modified polysiloxane is alone contained in the dye layer 2 by selecting from the polyether modified silicone having a viscosity of not less than 1000 $mm^2/s$ at 25° C. and the polyester modified polysiloxane, it is preferable that the polyester modified polysiloxane is contained at an amount range of not less than 0.3% by weight and not more than 8% by weight on the basis of the total solid content weight of the binder resin in the dye layer 2. When the content of the polyester modified polysiloxane is less than 0.3% by weight on the basis of the total solid content weight of the binder resin in the dye layer 2, there is a tendency that the effect of improving the releasing property is lowered. On the other hand, if it is more than 8% by weight, there are cases where defects such as pinholes are appeared on the coated surface of the dye layer, and the storage stability is reduced so that the dye is precipitated out of the dye layer.

Further, in the case that both of the polyether modified silicone having a viscosity of not less than 1000 $mm^2/s$ at 25° C., and the polyester modified polysiloxane are contained in the dye layer 2, it is preferable that the polyether modified silicone having a viscosity of not less than 1000 $mm^2/s$ at 25° C., and the polyester modified polysiloxane are contained at an total amount thereof of not less than 0.5% by weight and not more than 5% by weight on the basis of the total solid content weight of the binder resin in the dye layer. By containing both of the polyether modified silicone having a viscosity of not less than 1000 $mm^2/s$ at 25° C., and the polyester modified polysiloxane within this range, it becomes possible to improve the storage stability while improving the releasing property to the aqueous dye-receiving layer.

Further, in the case that both of the polyether modified silicone having a viscosity of not less than 1000 $mm^2/s$ at 25° C., and the polyester modified polysiloxane are contained within the above mentioned preferable range in the dye layer 2, there is no particular limitation about the blending ratio of the polyether modified silicone having a viscosity of not less than 1000 $mm^2/s$ at 25° C., and the polyester modified polysiloxane. It is preferable, however, that the polyether modified silicone having a viscosity of not less than 1000 $mm^2/s$ at 25° C. is contained in the range of not less than 1% by weight and not more than 99% by weight on the basis of the total weight of the polyether modified silicone having a viscosity of not less than 1000 $mm^2/s$ at 25° C., and the polyester modified polysiloxane.

Herein, the present invention is not intended to prohibit the dye layer 2 including a polyether modified silicone having a viscosity of less than 1000 $mm^2/s$ at 25° C., and a polysiloxiane other than the polyester modified polysiloxane. Without deviating from the range and the spirit of the present invention, various modified silicone may be contained. Further, the polyether modified silicone may be a silicone which was co-modified with the polyether group and another organic modifying group. Further, the polyester modified polysiloxane may be a polysiloxane which was co-modified with the polyester group and another organic modifying group.

<Binder Resin>

As the binder resin to be included in the dye layer 2, there is no particular limitation, and, it is possible to use any of conventionally known binder resin appropriately. As preferable binder resins, for instance, cellulosic resins such as ethylcellulose, hydroxyethylcellulose, ethylhydroxycellose, hydroxypropylcellulose, methylcellulose, cellulose acetate, and cellulose tributyrate; vinyl resins such as polyvinylalcohol, polyvinyl acetate, polyvinylbutyral, polyvinlacetal, and polyacrylamide; polyester resins, phenoxy resins and the like. Among them, polyvinlacetal resin and polyvinylbutyral resin are preferable from the points of heat resistance and dye-transfer efficiency.

<Sublimable Dye>

In the dye layer 2, sublimable dye(s) is contained. As the sublimable dye (s), any conventionally known dyes may be used. Examples of such sublimable dyes include diarylmethane dyes; triarylmethane dyes; thiazole dyes; merocyanine dyes; pyrazolone dyes; methine dyes; indoaniline dyes; azomethine dyes such as acetophenone azomethine dyes, pyrazolo azomethine dyes, imidazol eazomethine dyes, imidazo azomethine dyes, and pyridone azomethine dyes; xanthene dyes; oxazine dyes; cyanostyrene dyes such as dicyanostyrene dyes and tricyanostyrene dyes; thiazine dyes; azine dyes; acridine dyes; benzeneazo dyes; azo dyes such as, pyridoneazo dyes, thiopheneazo dyes, isothiazoleazo dyes, pyrroleazo dyes, pyrazoleazo dyes, imidazoleazo dyes, thiadiazoleazo dyes, triazoleazo dyes, and disazo dyes; spiropyran dyes; indolinospiropyran dyes; fluoran dyes; rhodaminelactam dyes; naphthoquinone dyes; anthraquinone dyes; and quinophthalone dyes.

It is preferable that the sublimable dye is not less than 50% by weight and not more than 350% by weight, more preferably, not less than 80% by weight and not more than 300% by weight, on the basis of the solid content of the binder resin of the dye layer 2. When the content of the sublimable dye is less than the above mentioned range, the print density may decrease in some cases, and when the content of the sublimable dye exceeds to the above mentioned ranges, the reservation property may decrease in some cases.

The dye layer 2 may contain optionally additives such as inorganic fine particles, organic fine particles, etc. Examples of such inorganic fine particles include carbon black, silica, molybdenum disulfide, etc. Examples of such organic fine particles include polyethylene waxes, etc. Further, the dye layer 2 may contain optionally other releasing agent in addition to the above mentioned polyether modified silicone and/or the polyester modified polysiloxane, without deviating from the range and the spirit of the present invention. Examples of such a releasing agent include phosphoric esters, etc.

There is no particular limitation for the method of forming the dye layer 2. The dye layer 2 may be formed by dissolving the polyether modified silicone having a viscosity of not less than 1000 $mm^2/s$ at 25° C., and/or the polyester modified polysiloxane, the binder resin, the sublimable dye, together with optional additives such as the releasing agent and inorganic particles, etc., in a suitable solvent such as toluene, methyl ethyl ketone, isopropyl alcohol, ethanol, cyclohexane, dimethyl formamide, etc., or dispersing them into an organic solvent or water to prepare a coating liquid; coating the coating liquid on the substrate by a conventional method such as gravure printing, die coat printing, bar coat printing, screen printing, reverse roll coating using a gravure plate, etc.; and drying the coated liquid. The coating amount of the dye layer 2 may be 0.2-4.0 g/m$^2$, preferably, 0.2-3.0 g/m$^2$, on the basis of dried solid content.

In the embodiment shown in FIG. 1, the configuration where a single dye layer 2 is provided on the substrate 1 is illustrated. However, it is possible to provide the dye layers 2 which include a mutually different dye, on the same surface of the same substrate 1 as being frame sequentially and repeatedly.

In the case that the dye layers 2 which include a mutually different dye are provided on the same surface of the same substrate 1 as being frame sequentially and repeatedly, the polyether modified silicone having a viscosity of not less than 1000 mm$^2$/s at 25° C., and/or the polyester modified polysiloxane may be contained in at least one dye layer. However, it is preferable that the polyether modified silicone having a viscosity of not less than 1000 mm$^2$/s at 25° C., and/or the polyester modified polysiloxane are contained in all of the dye layers. Further, it is preferable that the polyether modified silicone having a viscosity of not less than 1000 mm$^2$/s at 25° C., and/or the polyester modified polysiloxane are contained within the above mentioned preferable containing amount in all of the dye layers.

Further, by adding a releasing agent such as silicone oil to the dye-receiving layer 22 as described later, it is possible to further improve the release properties. However, when performing an image forming sequentially as primary color, a secondary color, in order, by using each dye layer provided frame sequentially, the releasing agent contained in the dye-receiving layer 22 is taken up to the dye layers 2 stepwise. Accordingly, the absolute amount of the releasing agent contained in the dye-receiving layer 22 decreases. For example, on the image formation of the primary color, the releasing agent contained in the dye-receiving layer 22 is taken up to the dye layer which was used for imaging the primary color, and thus amount of the releasing agent contained in the dye-receiving layer 22 on the image formation of the secondary color is smaller than the amount of the releasing agent contained in the dye-receiving layer 22 on the image formation of the primary color. Therefore, after forming an image of the primary color with using a dye layer 2, image formations are performed sequentially, such as secondary color, third color, or more, in order, the losses of the releasing property which may be occurred by stepwise decrement of the releasing agent in the dye receiving layer 22 is necessary to be compensated by the other dye layers' side.

Considering this point, in the case of a configuration where the dye layers are provided as being frame sequentially, it is preferable that the individual contents of the polyether modified silicone having a viscosity of not less than 1000 mm$^2$/s at 25° C., and/or the polyester modified polysiloxane in each individual dye layers are set to be the same within the above mentioned preferable content range, or are set to be gradually increased in accordance with the image forming sequence.

Incidentally, the present invention is not subject to mandatory that the releasing agent is contained in the dye receiving layer 22. Even when the releasing agent is not contained in the dye receiving layer 22, it is possible to achieve a sufficient releasing property, as long as the thermal transfer sheet which includes the dye layer 2 containing the polyether modified silicone having a viscosity of not less than 1000 mm$^2$/s at 25° C., and/or the polyester modified polysiloxane is used.

(Undercoat Layer)

In the present invention, it is preferable to provide an undercoat layer 3, between the substrate 1 and the dye layer 2. When the undercoat layer 3 is provided, it becomes possible to improve the adhesiveness between the substrate 1 and the dye layer 2, and thus, it becomes possible to prevent an abnormal transcription of the dye layer 2 to the thermal transfer image-receiving sheet on the thermal transcription.

As a polymer which can be used for constituting the undercoat layer 3, for instance, polyester type resins, polyacrylic ester type resins, polyvinyl acetate type resins, polyurethane type resins, styrene acrylate type resins, polyacrylamide type resins, polyamide type resins, polyether type resins, polystyrene type resins, polyethylene type resins, polypropylene type resins, vinyl type resins such as polyvinyl chloride resin and polyvinyl alcohol resin, polyvinyl acetal type resins such as polyvinyl acetoacetal and polyvinyl butyral, etc., are enumerated.

Moreover, the undercoat layer 3 may be composed of colloidal inorganic pigment's ultrafine particles. When applying it, the thermal transfer sheet is not only becoming possible to prevent an abnormal transcription of the dye layer 2 to the thermal transfer image-receiving sheet on the thermal transcription, but is also becoming possible to enhance the printing density since transferring of dye from the dye layer 2 to the undercoat layer 3 can be inhibited and the dye diffusion to the dye receiving layer of the thermal transfer image-receiving sheet can be duly and effectively promoted.

As the colloidal inorganic pigment's ultrafine particles, any known compound in this art can be used. For instance, silica (colloidal silica), alumina or alumina hydrate (such as alumina sol, colloidal alumina, cationic aluminum oxide or the hydrate thereof, and pseudo boehmite), aluminum silicate, magnesium silicate, magnesium carbonate, magnesium oxide, titanium oxide, etc., are exemplified. Particularly, colloidal silica or alumina sol is preferably used. Primary average particle size of these colloidal inorganic pigment's ultrafine particles is not more than 100 nm, preferably, not more than 50 nm.

The undercoat layer 3 may be formed by dissolving or dispersing any of the above exemplified resins or the above exemplified colloidal inorganic pigment's ultrafine particles, in a suitable solvent to prepare a coating liquid for forming the undercoat layer; coating the coating liquid by a conventional method such as gravure coating, roll coating method, screen printing method, reverse roll coating method using a gravure plate, etc.; and drying the coated liquid. It is desirable that the coating amount of the liquid for forming the undercoat layer is in the range of about 0.02-1.0 g/m$^2$.

(Back Face Layer)

Further, as shown in FIG. 1, the thermal transfer sheet according to the present invention may be equipped with a back face layer 4 on the opposite side of the substrate 1 in order to improve the heat resistance and the running property of the thermal head on printing, and the like. It should be noted that, however, the back face layer 4 is an optional constituent in the thermal transfer sheet 10 which is used in the image forming method, and the combination of the thermal transfer sheet and the thermal transfer image-receiving sheet according to the present invention.

The back face layer 4 may be formed by appropriately selecting any thermoplastic resin known in the art. Such thermoplastic resins include, for example, polyester resins, polyacrylate resins, polyvinyl acetate resins, styrene acrylate resins, polyurethane resins, polyolefin resins such as polyethylene resins, polypropylene resins, polystyrene resins, polyvinyl chloride resins, polyether resins, polyamide resins, polyimide resins, polyamide-imide resins, polycarbonate resins, polyacrylamide resins, polyvinyl chloride resins, polyvinyl butyral resins, polyvinyl acetal resins such as polyvinyl acetoacetal resins, and silicone-modified products thereof.

Further, there may be added a curing agent to the resin described above. With respect to the polyisocyanate resin which functions as a curing agent, there is no particular limitation, and any of conventionally known ones are usable. Among them, it is preferable to use an adduct of aromatic isocyanate. As the aromatic polyisocyanate, for instance, 2,4-toluene diisocyanate, 2,6-toluene diisocyanate, or a mixture of 2,4-toluene diisocyanate and 2,6-toluene diisocyanatehexamethylene diisocyanate, 1,5-naphtalene diisocyanate, tolidine diisocyanate, p-phenylene diisocyanate, trans-cyclohexane, 1,4-diisocyanate, xylylene diisocyanate, triphenyl methane triisocyanate, and tris(isocyanate phenyl)thiophosphate may be enumerated. Among them, 2,4-toluene diisocyanate, 2,6-toluene diisocyanate, or a mixture of 2,4-toluene diisocyanate and 2,6-toluene diisocyanate are particularly preferable. These polyisocyanate resins are cross-linked with the above mentioned hydroxyl group-containing thermoplastic resin by utilizing the hydroxyl group of the thermoplastic resin, and thereby, improve the heat resistance and the film strength of the back face layer.

Further, in the back face layer, in addition to the above mentioned thermal transfer resin, it is preferable to include various additives in order to improve the slipping property, for instance, waxes, higher fatty acid amides, phosphoric ester compounds; metallic soaps; silicone oil; releasing agent such as surfactants, organic powder such as fluorine containing resins, inorganic powder such as silica, clay, talc, calcium carbonate, etc. It is particularly preferable that at least one of phosphoric esters and metal soaps is included among them.

The back face layer 3 may be formed by dissolving or dispersing the above mentioned thermoplastic resin, and optionally, various additives to be added into a suitable solvent; coating thus prepared coating liquid onto a surface of the substrate 1 which is opposite to the surface side that the dye layer 2 is provided, in accordance with a known coating procedure such as the gravure printing method, the screen printing method, the reverse roll coating method using a gravure plate, or the like; and then drying the coated liquid. With respect to the coating amount of the back face layer, it is preferable to be in the range of not more than 3 $g/m^2$ in the dried state, and more preferably, in the range of 0.1-2 $g/m^2$ in the dried state.

<<Thermal Transfer Image-Receiving Sheet>>

Next, the thermal transfer image-receiving sheet which is usable in the image forming method and the combination of the thermal transfer sheet and the thermal transfer image-receiving sheet according to the present invention will be described. As shown in FIG. 2, the thermal transfer image-receiving sheet 30 to be used in the present invention takes a structure where a dye-receiving layer 22 is provided on one surface of another substrate 21. In FIG. 2, a thermal insulation layer 25 is provided between the other layer 21 and the dye-receiving layer 22. However, the thermal insulation layer 25 is an optional component of the thermal transfer image-receiving sheet 30 to be used in the present invention. Hereinafter, the respective components of the thermal transfer image-receiving sheet will be specifically described.

(Other Substrate)

The other substrate 21 is an essential component of the thermal transfer image-receiving sheet 30 to be used in the present invention, and it is provided for the purpose of supporting the dye-receiving layer 22, or the thermal insulation layer 25 which is the optional component. The substrate 21 is not particularly limited, and may be composed of an arbitrarily material including: stretched or unstretched plastic films, such as, polyesters of having high heat resistance such as polyethylene terephthalate and polyethylene naphthalate, polypropylenes, polycarbonates, cellulose acetates, poly ethylene derivatives, polyamides, polymethyl pentene and so on; and white opaque films which are formed as film by adding a white pigment or a filler to any of such synthetic resins. In addition, papers, such as, fine quality papers, coated papers, art papers, cast coated papers, paperboard and so on are also usable. Further, it is also possible to use a composite film in which two or more of these materials are laminated. As typical examples of such a laminated material, a combination of a cellulose fiber paper and a synthetic paper, and a combination of cellulose synthetic paper, plastic film and synthetic paper can be enumerated.

Although the thickness of the other substrate 1 can be appropriately selected depending on the kind of the material used so as to make it suitable in strength, heat resistance and so on, the thickness is usually in the range of about 50 μm-about 1000 μm, and, preferably in the range of about 60 μm-about 300 μm.

(Dye Receiving Layer)

A dye receiving layer 22 is provided on the other substrate 21. The dye receiving layer 22 is an essential component of the thermal transfer image-receiving sheet 30 which is used in the present invention.

In the present invention, it is characterized that the dye receiving layer 22 is an aqueous type dye receiving layer. By using the thermal transfer image-receiving sheet which has the aqueous type dye receiving layer on the formation of the image, it is possible to obtain an image having a high glossiness. Although the aqueous type dye receiving layer 22 has a low releasing property to the dye layer 2, since it is used in combination with the above explained thermal transfer sheet 10 in the image forming method according to the present invention, it is possible to form an image without the occurrence of the released mark, and without deteriorating a high glossiness that is an advantage in use of the aqueous type dye receiving layer 22.

In the present invention, the aqueous type dye receiving layer means a dye layer which is formed by using an aqueous coating liquid in which a resin capable of dispersing or dissolving in an aqueous solvent, for example, a water-soluble resin, a water-soluble polymer or a water-based resin is dissolved or dispersed in an aqueous solvent. As water-soluble resin or a water-soluble polymer, for instance, polyvinyl pyrrolidone, polyvinyl alcohol, hydroethyl cellulose, carboxymethyl cellulose, phenolic resins, water-soluble acrylic resin such as polyacrylic acid, polyacrylic esters, polyacrylic ester copolymer, poly methacrylic acid, gelatin, starch, and casein and modified derivatives thereof, may be enumerated. As water-base resin, for instance, vinyl chloride type resin emulsions such as vinyl chloride resin emulsion, vinyl chloride-vinyl acetate resin emulsion, vinyl chloride-acrylic resin emulsion; acrylic resin emulsion; urethane resin emulsion; vinyl chloride type resin dispersion; acrylic resin dispersion; and urethane resin dispersion, each of which solvent comprises water at least in a part, may be enumerated. For example, the above described water-based resin may be prepared by dispersing a solution including the solvent type resin with a homogenizer or the like.

It is preferable that the water-soluble resin, the water-soluble polymer or the water-based resin is contained in the range of not less than 50% by weight and not more than 95% by weight on the basis of the total solid content of the dye receiving layer 22. By using a dye receiving layer 22 in which aqueous resin is contained within the above mentioned range, it is possible to impart high glossiness to an image to be formed.

Into the dye receiving layer 22, the release agent for enhancing the release to the dye layer 2 of the thermal transfer sheet 10 is preferably added.

As a releasing agent to be used in combination with the water-soluble resin, the water-soluble polymer or the water-based resin, for instance, silicone oil (including those referred to as silicone resin); solid waxes such as polyethylene wax, amide wax, Teflon (registered trademark) powder, etc.; surfactants such as fluorine-based and phosphate ester-based surfactants, etc., may be enumerated. Among them, silicone oil is preferred. Further, when the silicone oil is also contained into the dye receiving layer 22 side, it is possible to improve the releasing property further, and to form an image with a high glossiness, by the synergistic effect with the above mentioned thermal transfer sheet 10 which is provided with the dye layer 2 which contains the polyether modified silicone having a viscosity of not less than 1000 $mm^2/s$ at 25° C., and/or the polyester modified polysiloxane.

As the silicone oil included in the dye receiving layer, it is possible to use various modified silicones. As the modified silicone oil, for instance, silicone oils that each is amino-modified, epoxy-modified, carboxyl-modified, carbinol-modified, methacryl-modified, mercapto-modified, phenol-modified, polyether-modified, methylstyryl-modified, alkyl-modified, aralkyl-modified, higher fatty acid ester-modified, hydrophilic specific modified, higher alkoxy-modified, higher fatty acid-modified, fluorine-modified, etc. may be enumerated. Each of these various modified silicone oils can be used singly or in combination of two or more.

There is no particular limitation for the content of the silicone oil(s) contained in the dye receiving layer 22. It is preferable, however, to be in the range of not less than 0.05% by weight and not more than 15% by weight on the basis of the total solid content of the dye receiving layer that contains the water-soluble resin, the water-soluble polymer as the binder resin, and the water-based resin. When the content exceeds 15% by weight, there is a possibility that bleeding will happen on the dye receiving layer 22, while it may not expect to obtain the synergistic effect with the thermal transfer sheet when the content is less than 0.05% by weight.

Further, it is preferable that the total weight of the polyether modified silicone having a viscosity of not less than 1000 $mm^2/s$ at 25° C., and/or the polyester modified polysiloxane which are contained in the dye layer 2, and the silicone oil(s) which is contained in the dye receiving layer 22 is within the range of not less than 0.5% by weight and not more than 15% by weight on the basis of the total solid content of the binder resin which is contained in the dye layer 2 of the thermal transfer sheet 2, and the water-soluble resin, the water-soluble polymer, and/or the water-based resin which are contained as the binder resin in the thermal transfer image-receiving sheet. When the total weight of the polyether modified silicone having a viscosity of not less than 1000 $mm^2/s$ at 25° C., and/or the polyester modified polysiloxane which are contained in the dye layer 2, and the silicone oil(s) which is contained in the dye receiving layer 22 is within the range, it is expected to improve further the releasing property.

The dye receiving layer 22 may be formed by dissolving or dispersing any of the water-soluble resin, the water-soluble polymer, and/or the water-based resin, and optionally, any additives to be added as needed, in water or an aqueous solution to prepare an aqueous coating liquid; coating the aqueous coating liquid onto the other substrate 21 by a conventional method such as wire-bar coating, gravure coating, slide coating, roll coating method, etc.; and drying the coated liquid. When preparing the aqueous coating liquid, it is desirable that, depending on the solubility or dispersibility in water of the aqueous resin to be used, the resin are dissolved or dispersed in water. There is no particular limitation for the thickness of the dye-receiving layer 22, but in general, it is in the range of 0.5 μm-10 μm.

(Sealing Layer)

Further, since the dye receiving layer 22 is formed by using an aqueous coating liquid, for example, in the case that a coated paper is used as the other substrate 21, the coated is compelled to absorb water, and which brings a fear that the thermal transfer image-receiving sheet 30 may curl up. Thus, when as the other substrate 21 a substrate of high water absorption is used, it is preferable that a sealing layer (not shown in figures) is provided between the other substrate 21 and the dye receiving layer 22. Incidentally, the sealing layer is not required if any other layer is provided between the substrate 21 and the dye receiving layer 22 and the other layer interested is formed without using an aqueous coating liquid. On the other hand, if the other layer, for instance, an insulating layer 25 as described below is directly formed on the substrate 21 by using an aqueous coating liquid, it is preferable to provide the sealing layer for the same reason as above.

With respect to the sealing layer 6, as long as it can produce a waterproof function, its material and other conditions are not particularly limited. For instance, it may be made of polyester resin, acrylic resin, acryl-urethane type resin, vinyl chloride resin or the like, or it may be formed from an emulsion such as (meth)acrylic acid alkyl ester homopolymer based emulsion, (meth)acrylic acid alkyl ester-styrene copolymer based emulsion, (meth)acrylic acid alkyl ester-vinyl acetate copolymer based emulsion, cement based filler containing emulsion or the like.

The thickness of the sealing layer is not particularly limited, but preferably, it is in the range of about 0.2 $g/m^2$-about 10.0 $g/m^2$.

(Insulating Layer)

Insulating layer 25 may be provided between the other substrate 21 and the dye receiving layer 22. By providing the insulating layer 25, it is possible to prevent the printing density from becoming lower. Because, the heat applied to the dye-receiving layer 22 from the thermal head is transferred to the other substrate 21 or the like, and this heat loss has caused the lowering of the printing density. The insulating layer can prevent this heat loss. Hereinafter, a description will be given of an example of the heat insulating layer. Apart from this example, however, it can be appropriately selected and used any of those known to be referred to as "insulating layer", "hollow (particles) layer" and "thermal insulating layer"

In the insulating layer 25, hollow particles are contained in general, and which give the thermal insulation and cushioning functions to the insulating layer 2. As the hollow particles, foamed particles may be used, or, alternatively, non-foamed particles may be also used. Furthermore, the foamed particles as used for the hollow particles can be closed-cell particles, or open-cell particles. Moreover, the hollow particles may be organic hollow particles which are constituted by a resin or the like, or may be inorganic hollow particles the hollow particles which are constituted by glass or the like. In addition, the hollow particles may be cross-linked hollow particles.

As the resin constituting the hollow particles includes, for example, styrene type resins such as cross-linked styrene-acrylic resin; (meth)acrylic resins such as acrylonitrile-acrylic resin; phenolic resins; fluorine containing resins; polyamide type resins; polyimide type resins, polycarbonate type resins; polyether type resins, and so on. The average particle diameter of the hollow particles can be set as appropriate in accordance with the kind of resin which constitutes the hollow particles, and thus there is no particular limitation, but is generally preferably in the range of 0.1 μm-15 μm, and particularly preferably in the range of 0.1 μm-10 μm. This is because, when the average particle diameter is too small, the amount of the hollow particles increases, and the cost increases. On the other hand, when the average particle diameter is too large, it becomes difficult to form a smooth insulating layer.

In the present invention, the amount of the hollow particles contained in the insulating layer 25 can be set as appropriate as far as desired heat insulation and cushioning functions can be obtained, and thus there is no particular limitation. However, the amount of the hollow particles is preferably set in the range of 30% by weight to 90% by weight, and more preferably set in the range of 50% by weight to 80% by weight. This is because, when the amount is too small, the voids in the insulating layer are reduced, and thus, there is a possibility that sufficient insulation and cushioning properties cannot be obtained. On the other hand, when the amount is too large, there is a possibility that the adhesiveness becomes inferior.

The thermal transfer image-receiving sheet 30 may have one or more of various functional layers. As such various functional layers, for example, a primer layer for enhancing the adhesiveness between the other substrate 21 and the dye receiving layer 22 or the insulating layer 25, a barrier layer for improving solvent resistance, etc., can be enumerated. Further, a back face layer may be provided on another surface of the other substrate 21, which differs from the surface onto which the dye receiving layer 22 is provided, in order to bring a function for improving transport of the thermal transfer image-receiving sheet, or a function of preventing the curl. As described above, with respect to the thermal transfer image-receiving sheet 30 used in the present invention, there are not any limitation for the other various functional layers, as long as it comprises the aqueous dye receiving layer 22 as an essential constituent.

(Formation of Image)

In the present invention, it is possible to form an image by superposing the dye layer 2 of the thermal transfer sheet 10 described above and a dye-receiving layer 22 of the thermal transfer image-receiving sheet 30, applying heat from the back side of the thermal transfer sheet 10 by a heating means such as a thermal head, etc., and thereby transferring the dye contained in the dye layer 2 to the dye-receiving layer 22.

EXAMPLES

Hereinafter, the present invention will be described with referring to Examples and Comparative Examples. Herein, the simplified expressions of "part(s)" in this specification mean "part(s) by weight", unless otherwise especially mentioned.

(Preparation of Thermal Transfer Sheet 1)

As a substrate, polyethylene terephthalate film which had 5 μm in thickness was used. On this substrate, a liquid for forming back face layer having the following composition was coated so as to obtain a thickness of 1.0 g/m$^2$ in the dried state and then the coated liquid was dried to form a back face layer. Then, on another surface reverse to the surface onto which the back face layer was provided, a liquid for forming undercoat layer having the following composition was coated so as to obtain a thickness of 0.10 g/m$^2$ in the dried state, and the coated liquid was dried to form an undercoat layer. Subsequently, a liquid for forming yellow dye layer 1 having the following composition was coated on the undercoat layer so as to obtain a thickness of 0.8 g/m$^2$ in the dried state, and then the coated liquid was dried in order to form the yellow thermal transfer sheet. The same procedure was repeated, except that the liquid for forming yellow dye layer 1 was replaced by a liquid for forming magenta dye layer 1 having the following composition, and a liquid for forming cyan dye layer 1 having the following composition individually, in order to form the magenta thermal transfer sheet and the cyan thermal transfer sheet, respectively. Then, thus obtained, yellow thermal transfer sheet, magenta thermal transfer sheet and cyan thermal transfer sheet were cut and adhered to yellow part, magenta part and cyan part of a genuine ribbon (CW-MS46) for CW-01 (manufactured by Citizen Systems Japan Co., Ltd.), respectively, in order to prepare a thermal transfer sheet 1.

<Liquid for Forming Back Face Layer>

| | |
|---|---|
| Polyvinyl acetal resin (S-LEC BX-1, manufactured by Sekisui Chemical Co., Ltd.) | 6.0 parts |
| Polyisocyanate curing agent (BURNOCK D750-45, manufactured by DIC Corporation) | 22.0 parts |
| Phosphate (PLYSURF A-208N, manufactured by Dai-ichi Kogyo Seiyaku Co., Ltd.) | 3.0 parts |
| Talc (MICRO ACE P-3, manufactured by Nippon Talc Co., Ltd.) | 1.0 part |
| methyl ethyl ketone | 60.0 parts |
| toluene | 60.0 parts |

<Liquid for Forming Undercoat Layer>

| | |
|---|---|
| Colloidal silica (particle diameter: 4-6 nm, solid content: 10%) (Snowtex OXS, manufactured by Nissan Chemical Industries Ltd.) | 30 parts |
| Polyvinyl pyrrolidone resin (K-90, manufactured by ISP) | 3 parts |
| Water | 50 parts |
| Isopropyl alcohol | 17 parts |

<Liquid for Forming Yellow Dye Layer 1>

| | |
|---|---|
| Dye represented by the following formula (Y-1) | 2.0 parts |
| Dye represented by the following formula (Y-2) | 2.0 parts |
| Polyvinyl butyral resin (S-LEC BX-1, manufactured by Sekisui Chemical Co., Ltd.) | 3.5 parts |
| polyether modified silicone (Viscosity: 3,500 mm$^2$/s at 25° C.) (FZ2164, manufactured by Dow Corning Toray Co., Ltd.) | 0.105 part |
| Methyl ethyl ketone | 45.0 parts |
| Toluene | 45.0 parts |

[Chem. 3]

(Y-1)

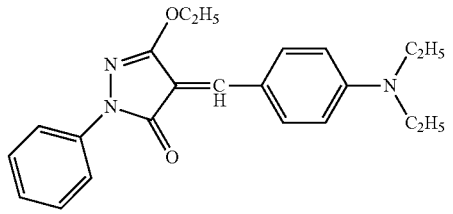

-continued (Y-2)

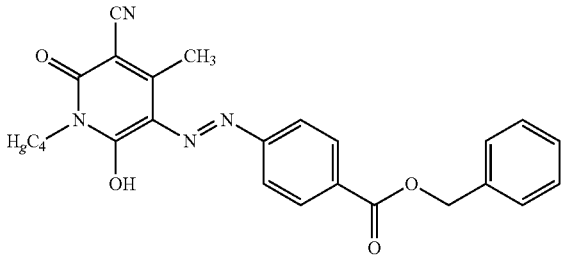

<Liquid for Forming Magenta Dye Layer 1>

| | |
|---|---|
| Dye represented by the following formula (M-1) | 2.0 parts |
| Dye represented by the following formula (M-2) | 2.0 parts |
| Polyvinyl butyral resin (S-LEC BX-1, manufactured by Sekisui Chemical Co., Ltd.) | 3.5 parts |
| polyether modified silicone (viscosity: 3,500 $mm^2/s$ at 25° C.) (FZ2164, manufactured by Dow Corning Toray Co., Ltd.) | 0.105 part |
| Methyl ethyl ketone | 45.0 parts |
| Toluene | 45.0 parts |

[Chem. 4]

(M-1)

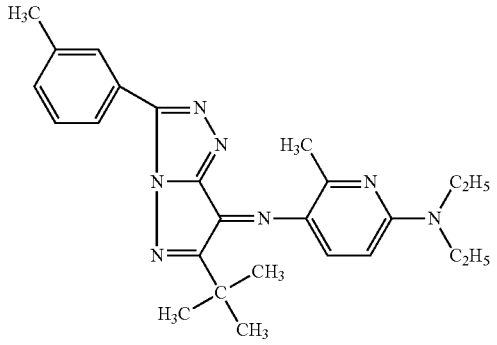

(M-2)

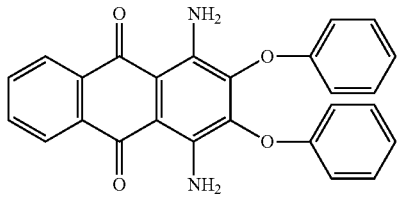

<Liquid for Forming Cyan Dye Layer 1>

| | |
|---|---|
| Dye represented by the following formula (C-1) | 2.0 parts |
| Dye represented by the following formula (C-2) | 1.0 part |
| Dye represented by the following formula (C-3) | 1.0 part |
| Polyvinyl butyral resin (S-LEC BX-1, manufactured by Sekisui Chemical Co., Ltd.) | 3.5 parts |
| polyether modified silicone (viscosity: 3,500 $mm^2/s$ at 25° C.) (FZ2164, manufactured by Dow Corning Toray Co., Ltd.) | 0.105 part |
| Methyl ethyl ketone | 45.0 parts |
| Toluene | 45.0 parts |

[Chem. 5]

(C-1)

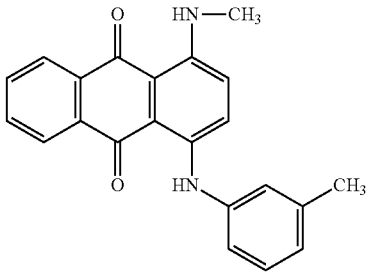

(C-2)

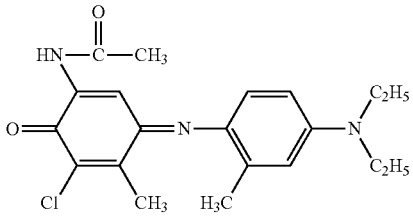

(C-3)

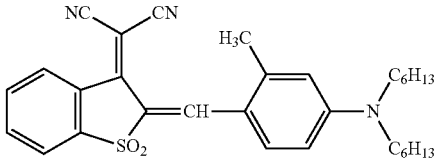

(Preparation of Thermal Transfer Sheet 2)

After forming a back layer and a undercoat layer according to the same manner as in the case of thermal transfer sheet 1, a liquid for forming yellow dye layer 2 having the following composition, a liquid for forming magenta dye layer 2 having the following composition, and a liquid for forming cyan dye layer 2 were coated on the undercoat layer respectively. Then, thus obtained, respective color sheets were cut and adhered in the same manner as in the case of thermal transfer sheet of Example 1, in order to prepare a thermal transfer sheet 2.

<Liquid for Forming Yellow Dye Layer 2>

| | |
|---|---|
| Dye represented by the following formula (Y-1) | 2.0 parts |
| Dye represented by the following formula (Y-2) | 2.0 parts |
| Polyvinyl acetal resin (S-LEC KS-5, manufactured by Sekisui Chemical Co., Ltd.) | 3.5 parts |
| polyether modified silicone (viscosity: 3,500 $mm^2/s$ at 25° C.) (FZ2164, manufactured by Dow Corning Toray Co., Ltd.) | 0.105 part |
| Methyl ethyl ketone | 45.0 parts |
| Toluene | 45.0 parts |

<Liquid for Forming Magenta Dye Layer 2>

| | |
|---|---|
| Dye represented by the following formula (M-1) | 2.0 parts |
| Dye represented by the following formula (M-2) | 2.0 parts |
| Polyvinyl acetal resin (S-LEC KS-5, manufactured by Sekisui Chemical Co., Ltd.) | 3.5 parts |
| polyether modified silicone (viscosity: 3,500 $mm^2/s$ at 25° C.) (FZ2164, manufactured by Dow Corning Toray Co., Ltd.) | 0.105 part |
| Methyl ethyl ketone | 45.0 parts |
| Toluene | 45.0 parts |

<Liquid for Forming Cyan Dye Layer 2>

| | |
|---|---|
| Dye represented by the following formula (C-1) | 2.0 parts |
| Dye represented by the following formula (C-2) | 1.0 part |
| Dye represented by the following formula (C-3) | 1.0 part |
| Polyvinyl acetal resin (S-LEC KS-5, manufactured by Sekisui Chemical Co., Ltd.) | 3.5 parts |
| polyether modified silicone (viscosity: 3,500 $mm^2/s$ at 25° C.) (FZ2164, manufactured by Dow Corning Toray Co., Ltd.) | 0.105 part |
| Methyl ethyl ketone | 45.0 parts |
| Toluene | 45.0 parts |

(Preparation of Thermal Transfer Sheet 3)

A thermal transfer sheet 3 was obtained by carrying out the same procedure in the preparation of the thermal transfer sheet 2 except that the amounts of polyether modified silicone (viscosity: 3,500 $mm^2/s$ at 25° C.) (FZ2164, manufactured by Dow Corning Toray Co., Ltd.) in the respective liquids for forming yellow, magenta, and cyan dye layers were changed from 0.105 part to 0.0105 part.

(Preparation of Thermal Transfer Sheet 4)

A thermal transfer sheet 4 was obtained by carrying out the same procedure in the preparation of the thermal transfer sheet 2 except that the amounts of polyether modified silicone (viscosity: 3,500 $mm^2/s$ at 25° C.) (FZ2164, manufactured by Dow Corning Toray Co., Ltd.) in the respective liquids for forming yellow, magenta, and cyan dye layers were changed from 0.105 part to 0.0175 part.

(Preparation of Thermal Transfer Sheet 5)

A thermal transfer sheet 5 was obtained by carrying out the same procedure in the preparation of the thermal transfer sheet 2 except that the amounts of polyether modified silicone (viscosity: 3,500 $mm^2/s$ at 25° C.) (FZ2164, manufactured by Dow Corning Toray Co., Ltd.) in the respective liquids for forming yellow, magenta, and cyan dye layers were changed from 0.105 part to 0.175 part.

(Preparation of Thermal Transfer Sheet 6)

A thermal transfer sheet 6 was obtained by carrying out the same procedure in the preparation of the thermal transfer sheet 2 except that the amounts of polyether modified silicone (viscosity: 3,500 $mm^2/s$ at 25° C.) (FZ2164, manufactured by Dow Corning Toray Co., Ltd.) in the respective liquids for forming yellow, magenta, and cyan dye layers were changed from 0.105 part to 0.245 part.

(Preparation of Thermal Transfer Sheet 7)

A thermal transfer sheet 7 was obtained by carrying out the same procedure in the preparation of the thermal transfer sheet 2 except that 0.105 part of polyether modified silicone (viscosity: 3,500 $mm^2/s$ at 25° C.) (FZ2164, manufactured by Dow Corning Toray Co., Ltd.) in the respective liquids for forming yellow, magenta, and cyan dye layers were replaced by 0.105 part of polyether modified silicone (viscosity: 4,500 $mm^2/s$ at 25° C.) (X-22-4515, manufactured by Shin-Etsu Chemical Co., Ltd.).

(Preparation of Thermal Transfer Sheet 8)

A thermal transfer sheet 8 was obtained by carrying out the same procedure in the preparation of the thermal transfer sheet 2 except that 0.105 part of polyether modified silicone (viscosity: 3,500 $mm^2/s$ at 25° C.) (FZ2164, manufactured by Dow Corning Toray Co., Ltd.) in the respective liquids for forming yellow, magenta, and cyan dye layers were replaced by 0.105 part of polyether modified silicone (viscosity: 1,500 $mm^2/s$ at 25° C.) (KF-6012, manufactured by Shin-Etsu Chemical Co., Ltd.).

(Preparation of Thermal Transfer Sheet 9)

After forming a back layer and a undercoat layer according to the same manner as in the case of thermal transfer sheet 1, a liquid for forming yellow dye layer 3 having the following composition, a liquid for forming magenta dye layer 3 having the following composition, and a liquid for forming cyan dye layer 3 were coated on the undercoat layer respectively. Then, thus obtained, respective color sheets were cut and adhered in the same manner as in the case of thermal transfer sheet 1, in order to prepare a thermal transfer sheet 9.

<Liquid for Forming Yellow Dye Layer 3>

| | |
|---|---|
| Dye represented by the following formula (Y-1) | 2.0 parts |
| Dye represented by the following formula (Y-2) | 2.0 parts |
| Polyvinyl butyral resin (S-LEC BX-1, manufactured by Sekisui Chemical Co., Ltd.) | 3.5 parts |
| polyester modified polysiloxane compound (solid content: 25%) (BYK310, manufactured by BYK-Chemie GmbH) | 0.42 part |
| Methyl ethyl ketone | 45.0 parts |
| Toluene | 45.0 parts |

<Liquid for Forming Magenta Dye Layer 3>

| | |
|---|---|
| Dye represented by the following formula (M-1) | 2.0 parts |
| Dye represented by the following formula (M-2) | 2.0 parts |
| Polyvinyl butyral resin (S-LEC BX-1, manufactured by Sekisui Chemical Co., Ltd.) | 3.5 parts |
| polyester modified polysiloxane compound (solid content: 25%) (BYK310, manufactured by BYK-Chemie GmbH) | 0.42 part |
| Methyl ethyl ketone | 45.0 parts |
| Toluene | 45.0 parts |

<Liquid for Forming Cyan Dye Layer 3>

| | |
|---|---|
| Dye represented by the following formula (C-1) | 2.0 parts |
| Dye represented by the following formula (C-2) | 1.0 part |
| Dye represented by the following formula (C-3) | 1.0 part |
| Polyvinyl butyral resin (S-LEC BX-1, manufactured by Sekisui Chemical Co., Ltd.) | 3.5 parts |
| polyester modified polysiloxane compound (solid content: 25%) (BYK310, manufactured by BYK-Chemie GmbH) | 0.42 part |
| Methyl ethyl ketone | 45.0 parts |
| Toluene | 45.0 parts |

(Preparation of Thermal Transfer Sheet 10)

After forming a back layer and a undercoat layer according to the same manner as in the case of thermal transfer sheet 1, a liquid for forming yellow dye layer 4 having the following composition, a liquid for forming magenta dye layer 4 having the following composition, and a liquid for forming cyan dye layer 4 were coated on the undercoat layer respectively. Then, thus obtained, respective color sheets were cut and adhered in the same manner as in the case of thermal transfer sheet 1, in order to prepare a thermal transfer sheet 10.

<Liquid for Forming Yellow Dye Layer 4>

| | |
|---|---|
| Dye represented by the following formula (Y-1) | 2.0 parts |
| Dye represented by the following formula (Y-2) | 2.0 parts |
| Polyvinyl acetal resin (S-LEC KS-5, manufactured by Sekisui Chemical Co., Ltd.) | 3.5 parts |
| polyester modified polysiloxane compound (solid content: 25%) (BYK310, manufactured by BYK-Chemie GmbH) | 0.42 part |
| Methyl ethyl ketone | 45.0 parts |
| Toluene | 45.0 parts |

<Liquid for Forming Magenta Dye Layer 4>

| | |
|---|---|
| Dye represented by the following formula (M-1) | 2.0 parts |
| Dye represented by the following formula (M-2) | 2.0 parts |
| Polyvinyl acetal resin (S-LEC KS-5, manufactured by Sekisui Chemical Co., Ltd.) | 3.5 parts |
| polyester modified polysiloxane compound (solid content: 25%) (BYK310, manufactured by BYK-Chemie GmbH) | 0.42 part |
| Methyl ethyl ketone | 45.0 parts |
| Toluene | 45.0 parts |

<Liquid for Forming Cyan Dye Layer 4>

| | |
|---|---|
| Dye represented by the following formula (C-1) | 2.0 parts |
| Dye represented by the following formula (C-2) | 1.0 part |
| Dye represented by the following formula (C-3) | 1.0 part |
| Polyvinyl acetal resin (S-LEC KS-5, manufactured by Sekisui Chemical Co., Ltd.) | 3.5 parts |
| polyester modified polysiloxane compound (solid content: 25%) (BYK310, manufactured by BYK-Chemie GmbH) | 0.42 part |
| Methyl ethyl ketone | 45.0 parts |
| Toluene | 45.0 parts |

(Preparation of Thermal Transfer Sheet 11)

After forming a back layer and a undercoat layer according to the same manner as in the case of thermal transfer sheet 1, a liquid for forming yellow dye layer 5 having the following composition, a liquid for forming magenta dye layer 5 having the following composition, and a liquid for forming cyan dye layer 5 were coated on the undercoat layer respectively. Then, thus obtained, respective color sheets were cut and adhered in the same manner as in the case of thermal transfer sheet 1, in order to prepare a thermal transfer sheet 11.

<Liquid for Forming Yellow Dye Layer 5>

| | |
|---|---|
| Dye represented by the following formula (Y-1) | 2.0 parts |
| Dye represented by the following formula (Y-2) | 2.0 parts |
| Polyvinyl acetal resin (S-LEC KS-5, manufactured by Sekisui Chemical Co., Ltd.) | 3.5 parts |
| polyester modified polysiloxane compound (solid content: 15%) (BYK313, manufactured by BYK-Chemie GmbH) | 0.70 part |
| Methyl ethyl ketone | 45.0 parts |
| Toluene | 45.0 parts |

<Liquid for Forming Magenta Dye Layer 5>

| | |
|---|---|
| Dye represented by the following formula (M-1) | 2.0 parts |
| Dye represented by the following formula (M-2) | 2.0 parts |
| Polyvinyl acetal resin (S-LEC KS-5, manufactured by Sekisui Chemical Co., Ltd.) | 3.5 parts |
| polyester modified polysiloxane compound (solid content: 15%) (BYK313, manufactured by BYK-Chemie GmbH) | 0.70 part |
| Methyl ethyl ketone | 45.0 parts |
| Toluene | 45.0 parts |

<Liquid for Forming Cyan Dye Layer 5>

| | |
|---|---|
| Dye represented by the following formula (C-1) | 2.0 parts |
| Dye represented by the following formula (C-2) | 1.0 part |
| Dye represented by the following formula (C-3) | 1.0 part |
| Polyvinyl acetal resin (S-LEC KS-5, manufactured by Sekisui Chemical Co., Ltd.) | 3.5 parts |
| polyester modified polysiloxane compound (solid content: 15%) (BYK313, manufactured by BYK-Chemie GmbH) | 0.70 part |
| Methyl ethyl ketone | 45.0 parts |
| Toluene | 45.0 parts |

(Preparation of Thermal Transfer Sheet 12)

After forming a back layer and a undercoat layer according to the same manner as in the case of thermal transfer sheet 1, a liquid for forming yellow dye layer 6 having the following composition, a liquid for forming magenta dye layer 6 having the following composition, and a liquid for forming cyan dye layer 6 were coated on the undercoat layer respectively. Then, thus obtained, respective color sheets were cut and adhered in the same manner as in the case of thermal transfer sheet 1, in order to prepare a thermal transfer sheet 12.

<Liquid for Forming Yellow Dye Layer 6>

| | |
|---|---|
| Dye represented by the following formula (Y-1) | 2.0 parts |
| Dye represented by the following formula (Y-2) | 2.0 parts |
| Polyvinyl acetal resin (S-LEC KS-5, manufactured by Sekisui Chemical Co., Ltd.) | 3.5 parts |
| polyester modified polysiloxane compound (solid content: 25%) (BYK315, manufactured by BYK-Chemie GmbH) | 0.07 part |
| Methyl ethyl ketone | 45.0 parts |
| Toluene | 45.0 parts |

<Liquid for Forming Magenta Dye Layer 6>

| | |
|---|---|
| Dye represented by the following formula (M-1) | 2.0 parts |
| Dye represented by the following formula (M-2) | 2.0 parts |
| Polyvinyl acetal resin (S-LEC KS-5, manufactured by Sekisui Chemical Co., Ltd.) | 3.5 parts |
| polyester modified polysiloxane compound (solid content: 25%) (BYK315, manufactured by BYK-Chemie GmbH) | 0.07 part |
| Methyl ethyl ketone | 45.0 parts |
| Toluene | 45.0 parts |

<Liquid for Forming Cyan Dye Layer 6>

| | |
|---|---|
| Dye represented by the following formula (C-1) | 2.0 parts |
| Dye represented by the following formula (C-2) | 1.0 part |
| Dye represented by the following formula (C-3) | 1.0 part |
| Polyvinyl acetal resin (S-LEC KS-5, manufactured by Sekisui Chemical Co., Ltd.) | 3.5 parts |
| polyester modified polysiloxane compound (solid content: 25%) (BYK315, manufactured by BYK-Chemie GmbH) | 0.07 part |
| Methyl ethyl ketone | 45.0 parts |
| Toluene | 45.0 parts |

(Preparation of Thermal Transfer Sheet 13)

A thermal transfer sheet 13 was obtained by carrying out the same procedure in the preparation of the thermal transfer sheet 12 except that the amounts of polyester modified polysiloxane compound in the respective liquids for forming yellow, magenta, and cyan dye layers 6 were changed from 0.07 part to 0.42 part.

(Preparation of Thermal Transfer Sheet 14)

A thermal transfer sheet 14 was obtained by carrying out the same procedure in the preparation of the thermal transfer sheet 12 except that the amounts of polyester modified polysiloxane compound in the respective liquids for forming yellow, magenta, and cyan dye layers 6 were changed from 0.07 part to 0.70 part.

(Preparation of Thermal Transfer Sheet 15)

A thermal transfer sheet 15 was obtained by carrying out the same procedure in the preparation of the thermal transfer sheet 12 except that the amounts of polyester modified polysiloxane compound in the respective liquids for forming yellow, magenta, and cyan dye layers 6 were changed from 0.07 part to 1.12 parts.

(Preparation of Thermal Transfer Sheet 16)

A thermal transfer sheet 16 was obtained by carrying out the same procedure in the preparation of the thermal transfer sheet 12 except that the amounts of polyester modified polysiloxane compound in the respective liquids for forming yellow, magenta, and cyan dye layers 6 were changed from 0.07 part to 0.042 part.

(Preparation of Thermal Transfer Sheet 17)

A thermal transfer sheet 17 was obtained by carrying out the same procedure in the preparation of the thermal transfer sheet 12 except that the amounts of polyester modified polysiloxane compound in the respective liquids for forming yellow, magenta, and cyan dye layers 6 were changed from 0.07 part to 1.40 part.

(Preparation of Thermal Transfer Sheet 18)

After forming a back layer and a undercoat layer according to the same manner as in the case of thermal transfer sheet 1, a liquid for forming yellow dye layer 7 having the following composition, a liquid for forming magenta dye layer 7 having the following composition, and a liquid for forming cyan dye layer 7 were coated on the undercoat layer respectively. Then, thus obtained, respective color sheets were cut and adhered in the same manner as in the case of thermal transfer sheet 1, in order to prepare a thermal transfer sheet 18.

<Liquid for Forming Yellow Dye Layer 7>

| | |
|---|---|
| Dye represented by the following formula (Y-1) | 2.0 parts |
| Dye represented by the following formula (Y-2) | 2.0 parts |
| Polyvinyl acetal resin (S-LEC KS-5, manufactured by Sekisui Chemical Co., Ltd.) | 3.5 parts |
| polyester modified polysiloxane compound (solid content: 25%) (BYK315, manufactured by BYK-Chemie GmbH) | 0.21 part |
| polyether modified silicone (viscosity: 3,500 $mm^2/s$ at 25° C.) (FZ2164, manufactured by Dow Corning Toray Co., Ltd.) | 0.0525 part |
| Methyl ethyl ketone | 45.0 parts |
| Toluene | 45.0 parts |

<Liquid for Forming Magenta Dye Layer 7>

| | |
|---|---|
| Dye represented by the following formula (M-1) | 2.0 parts |
| Dye represented by the following formula (M-2) | 2.0 parts |
| Polyvinyl acetal resin (S-LEC KS-5, manufactured by Sekisui Chemical Co., Ltd.) | 3.5 parts |
| polyester modified polysiloxane compound (solid content: 25%) (BYK315, manufactured by BYK-Chemie GmbH) | 0.21 part |
| polyether modified silicone (viscosity: 3,500 $mm^2/s$ at 25° C.) (FZ2164, manufactured by Dow Corning Toray Co., Ltd.) | 0.0525 part |
| Methyl ethyl ketone | 45.0 parts |
| Toluene | 45.0 parts |

<Liquid for Forming Cyan Dye Layer 7>

| | |
|---|---|
| Dye represented by the following formula (C-1) | 2.0 parts |
| Dye represented by the following formula (C-2) | 1.0 part |
| Dye represented by the following formula (C-3) | 1.0 part |
| Polyvinyl acetal resin (S-LEC KS-5, manufactured by Sekisui Chemical Co., Ltd.) | 3.5 parts |
| polyester modified polysiloxane compound (solid content: 25%) (BYK315, manufactured by BYK-Chemie GmbH) | 0.21 part |
| polyether modified silicone (viscosity: 3,500 $mm^2/s$ at 25° C.) (FZ2164, manufactured by Dow Corning Toray Co., Ltd.) | 0.0525 part |
| Methyl ethyl ketone | 45.0 parts |
| Toluene | 45.0 parts |

-continued (Preparation of Thermal Transfer Sheet 19)

After forming a back layer and a undercoat layer according to the same manner as in the case of thermal transfer sheet 1, a liquid for forming yellow dye layer 8 having the following composition, a liquid for forming magenta dye layer 8 having the following composition, and a liquid for forming cyan dye layer 8 were coated on the undercoat layer respectively. Then, thus obtained, respective color sheets were cut and adhered in the same manner as in the case of thermal transfer sheet 1, in order to prepare a thermal transfer sheet 19.

<Liquid for Forming Yellow Dye Layer 8>

| | |
|---|---|
| Dye represented by the following formula (Y-1) | 2.0 parts |
| Dye represented by the following formula (Y-2) | 2.0 parts |
| Polyvinyl acetal resin (S-LEC KS-5, manufactured by Sekisui Chemical Co., Ltd.) | 3.5 parts |
| polyester modified polysiloxane compound (solid content: 25%) (BYK310, manufactured by BYK-Chemie GmbH) | 0.21 part |
| polyether modified silicone (viscosity: 4,500 $mm^2/s$ at 25° C.) (X-22-4515, manufactured by Shin-Etsu Chemical Co., Ltd.) | 0.0525 part |
| Methyl ethyl ketone | 45.0 parts |
| Toluene | 45.0 parts |

<Liquid for Forming Magenta Dye Layer 8>

| | |
|---|---|
| Dye represented by the following formula (M-1) | 2.0 parts |
| Dye represented by the following formula (M-2) | 2.0 parts |
| Polyvinyl acetal resin (S-LEC KS-5, manufactured by Sekisui Chemical Co., Ltd.) | 3.5 parts |
| polyester modified polysiloxane compound (solid content: 25%) (BYK310, manufactured by BYK-Chemie GmbH) | 0.21 part |
| polyether modified silicone (viscosity: 4,500 $mm^2/s$ at 25° C.) (X-22-4515, manufactured by Shin-Etsu Chemical Co., Ltd.) | 0.0525 part |
| Methyl ethyl ketone | 45.0 parts |
| Toluene | 45.0 parts |

<Liquid for Forming Cyan Dye Layer 8>

| | |
|---|---|
| Dye represented by the following formula (C-1) | 2.0 parts |
| Dye represented by the following formula (C-2) | 1.0 part |
| Dye represented by the following formula (C-3) | 1.0 part |
| Polyvinyl acetal resin (S-LEC KS-5, manufactured by Sekisui Chemical Co., Ltd.) | 3.5 parts |
| polyester modified polysiloxane compound (solid content: 25%) (BYK310, manufactured by BYK-Chemie GmbH) | 0.21 part |
| polyether modified silicone (viscosity: 4,500 $mm^2/s$ at 25° C.) (X-22-4515, manufactured by Shin-Etsu Chemical Co., Ltd.) | 0.0525 part |
| Methyl ethyl ketone | 45.0 parts |
| Toluene | 45.0 parts |

(Preparation of Thermal Transfer Sheet 20)

After forming a back layer and a undercoat layer according to the same manner as in the case of thermal transfer sheet 1, a liquid for forming yellow dye layer 9 having the following composition, a liquid for forming magenta dye layer 9 having the following composition, and a liquid for forming cyan dye layer 9 were coated on the undercoat layer respectively. Then, thus obtained, respective color sheets were cut and adhered in the same manner as in the case of thermal transfer sheet 1, in order to prepare a thermal transfer sheet 20.

<Liquid for Forming Yellow Dye Layer 9>

| | |
|---|---|
| Dye represented by the following formula (Y-1) | 2.0 parts |
| Dye represented by the following formula (Y-2) | 2.0 parts |
| Polyvinyl acetal resin (S-LEC KS-5, manufactured by Sekisui Chemical Co., Ltd.) | 3.5 parts |
| polyester modified polysiloxane compound (solid content: 25%) (BYK315, manufactured by BYK-Chemie GmbH) | 0.35 part |
| polyether modified silicone (viscosity: 3,500 $mm^2/s$ at 25° C.) (FZ2164, manufactured by Dow Corning Toray Co., Ltd.) | 0.0175 part |
| Methyl ethyl ketone | 45.0 parts |
| Toluene | 45.0 parts |

<Liquid for Forming Magenta Dye Layer 9>

| | |
|---|---|
| Dye represented by the following formula (M-1) | 2.0 parts |
| Dye represented by the following formula (M-2) | 2.0 parts |
| Polyvinyl acetal resin (S-LEC KS-5, manufactured by Sekisui Chemical Co., Ltd.) | 3.5 parts |
| polyester modified polysiloxane compound (solid content: 25%) (BYK315, manufactured by BYK-Chemie GmbH) | 0.35 part |
| polyether modified silicone (viscosity: 3,500 $mm^2/s$ at 25° C.) (FZ2164, manufactured by Dow Corning Toray Co., Ltd.) | 0.0175 part |
| Methyl ethyl ketone | 45.0 parts |
| Toluene | 45.0 parts |

<Liquid for Forming Cyan Dye Layer 9>

| | |
|---|---|
| Dye represented by the following formula (C-1) | 2.0 parts |
| Dye represented by the following formula (C-2) | 1.0 part |
| Dye represented by the following formula (C-3) | 1.0 part |
| Polyvinyl acetal resin (S-LEC KS-5, manufactured by Sekisui Chemical Co., Ltd.) | 3.5 parts |
| polyester modified polysiloxane compound (solid content: 25%) (BYK315, manufactured by BYK-Chemie GmbH) | 0.35 part |
| polyether modified silicone (viscosity: 3,500 $mm^2/s$ at 25° C.) (FZ2164, manufactured by Dow Corning Toray Co., Ltd.) | 0.0175 part |
| Methyl ethyl ketone | 45.0 parts |
| Toluene | 45.0 parts |

(Preparation of Thermal Transfer Sheet A)

A thermal transfer sheet A was obtained by carrying out the same procedure in the preparation of the thermal transfer sheet 2 except that 0.105 part of polyether modified silicone (viscosity: 3,500 $mm^2/s$ at 25° C.) (FZ2164, manufactured by Dow Corning Toray Co., Ltd.) in the respective liquids for forming yellow, magenta, and cyan dye layers 2 were replaced by 0.105 part of amino modified silicone (viscosity: 3,500 $mm^2/s$ at 25° C.) (KF861, manufactured by Shin-Etsu Chemical Co., Ltd.).

(Preparation of Thermal Transfer Sheet B)

A thermal transfer sheet B was obtained by carrying out the same procedure in the preparation of the thermal transfer sheet 2 except that 0.105 part of polyether modified silicone (viscosity: 3,500 $mm^2/s$ at 25° C.) (FZ2164, manufactured by Dow Corning Toray Co., Ltd.) in the respective liquids for forming yellow, magenta, and cyan dye layers 2 were replaced by 0.105 part of epoxy modified silicone (viscosity: 6,000 $mm^2/s$ at 25° C.) (BY-16-839, manufactured by Dow Corning Toray Co., Ltd.).

(Preparation of Thermal Transfer Sheet C)

A thermal transfer sheet of Example C was obtained by carrying out the same procedure in the preparation of the thermal transfer sheet 2 except that 0.105 part of polyether modified silicone (viscosity: 3,500 $mm^2/s$ at 25° C.) (FZ2164, manufactured by Dow Corning Toray Co., Ltd.) in the respective liquids for forming yellow, magenta, and cyan dye layers 2 were replaced by 0.105 part of alkyl aralkyl modified silicone (viscosity: 1,400 $mm^2/s$ at 25° C.) (SH230, manufactured by Dow Corning Toray Co., Ltd.).

(Preparation of Thermal Transfer Sheet D)

A thermal transfer sheet D was obtained by carrying out the same procedure in the preparation of the thermal transfer sheet 2 except that 0.105 part of polyether modified silicone (viscosity: 3,500 $mm^2/s$ at 25° C.) (FZ2164, manufactured by Dow Corning Toray Co., Ltd.) in the respective liquids for forming yellow, magenta, and cyan dye layers 2 were replaced by 0.175 part of alkyl aralkyl modified silicone (viscosity: 1,400 $mm^2/s$ at 25° C.) (SH230, manufactured by Dow Corning Toray Co., Ltd.).

(Preparation of Thermal Transfer Sheet E)

A thermal transfer sheet E was obtained by carrying out the same procedure in the preparation of the thermal transfer sheet 2 except that 0.105 part of polyether modified silicone (viscosity: 3,500 $mm^2/s$ at 25° C.) (FZ2164, manufactured by Dow Corning Toray Co., Ltd.) in the respective liquids for forming yellow, magenta, and cyan dye layers 2 were replaced by 0.105 part of carboxyl modified silicone (viscosity: 2,000 $mm^2/s$ at 25° C.) (S-22-3701E, manufactured by Shin-Etsu Chemical Co., Ltd.).

(Preparation of Thermal Transfer Sheet F)

A thermal transfer sheet F was obtained by carrying out the same procedure in the preparation of the thermal transfer sheet 2 except that 0.105 part of polyether modified silicone (viscosity: 3,500 $mm^2/s$ at 25° C.) (FZ2164, manufactured by Dow Corning Toray Co., Ltd.) in the respective liquids for forming yellow, magenta, and cyan dye layers 2 were replaced by 0.105 part of polyether modified silicone (viscosity: 50 $mm^2/s$ at 25° C.) (KF-642, manufactured by Shin-Etsu Chemical Co., Ltd.).

(Preparation of Thermal Transfer Sheet G)

A thermal transfer sheet G was obtained by carrying out the same procedure in the preparation of the thermal transfer sheet 10 except that 0.42 part of polyester modified polysiloxane compound (BYK310, manufactured by BYK-Chemie GmbH, solid content: 25%) in the respective liquids for forming yellow, magenta, and cyan dye layers 4 were replaced by 0.11 part of aralkyl modified polysiloxane compound (BYK322, manufactured by BYK-Chemie GmbH, solid content: 98%).

(Preparation of Thermal Transfer Sheet H)

A thermal transfer sheet H was obtained by carrying out the same procedure in the preparation of the thermal transfer sheet 10 except that 0.42 part of polyester modified polysiloxane compound (BYK310, manufactured by BYK-Chemie GmbH, solid content: 25%) in the respective liquids for forming yellow, magenta, and cyan dye layers 4 were replaced by 0.70 part of acryl modified polysiloxane compound (Chaline RS-170, manufactured by Nissin Chemical Industry Co., Ltd, solid content: 15%).

(Preparation of Thermal Transfer Sheet I)

A thermal transfer sheet I was obtained by carrying out the same procedure in the preparation of the thermal transfer sheet 10 except that 0.42 part of polyester modified polysiloxane compound (BYK310, manufactured by BYK-Chemie GmbH, solid content: 25%) in the respective liquids for forming yellow, magenta, and cyan dye layers 4 were replaced by 0.35 part of silicone modified acryl (Cymac US-380, manufactured by TOAGOSEI Co., Ltd, solid content: 30%).

(Preparation of Thermal Transfer Sheet J)

A thermal transfer sheet J was obtained by carrying out the same procedure in the preparation of the thermal transfer sheet 10 except that 0.42 part of polyester modified polysiloxane compound (BYK310, manufactured by BYK-Chemie GmbH, solid content: 25%) in the respective liquids for forming yellow, magenta, and cyan dye layers 4 were replaced by 0.93 part of silicone modified acryl (Cymac US-380, manufactured by TOAGOSEI Co., Ltd, solid content: 30%).

(Preparation of Thermal Transfer Sheet K)

A thermal transfer sheet K was obtained by carrying out the same procedure in the preparation of the thermal transfer sheet 10 except that 0.42 part of polyester modified polysiloxane compound (BYK310, manufactured by BYK-Chemie GmbH, solid content: 25%) in the respective liquids for forming yellow, magenta, and cyan dye layers 4 were replaced by 0.53 part of silicone modified urethane (Daiallomer SP2105, manufactured by Dainichiseika Color & Chemicals Mfg. Co., Ltd., solid content: 20%).

(Preparation of Thermal Transfer Sheet L)

A thermal transfer sheet L was obtained by carrying out the same procedure in the preparation of the thermal transfer sheet 10 except that 0.42 part of polyester modified polysiloxane compound (BYK310, manufactured by BYK-Chemie GmbH, solid content: 25%) in the respective liquids for forming yellow, magenta, and cyan dye layers 4 were replaced by 1.40 parts of silicone modified urethane (Daiallomer SP2105, manufactured by Dainichiseika Color & Chemicals Mfg. Co., Ltd., solid content: 20%).

(Preparation of Thermal Transfer Sheet M)

A thermal transfer sheet M was obtained by carrying out the same procedure in the preparation of the thermal transfer sheet 10 except that 0.42 part of polyester modified polysiloxane compound (BYK310, manufactured by BYK-Chemie GmbH, solid content: 25%) in the respective liquids for forming yellow, magenta, and cyan dye layers 4 were replaced by 0.84 part of silicone modified acetal (Daiallomer SP755, manufactured by Dainichiseika Color & Chemicals Mfg. Co., Ltd., solid content: 12.5%).

(Preparation of Thermal Transfer Sheet N)

A thermal transfer sheet of Example N was obtained by carrying out the same procedure in the preparation of the thermal transfer sheet 10 except that 0.42 part of polyester modified polysiloxane compound (BYK310, manufactured by BYK-Chemie GmbH, solid content: 25%) in the respective liquids for forming yellow, magenta, and cyan dye layers 4 were replaced by 0.105 part of carbinol modified silicone oil (X-22-4015, manufactured by Shin-Etsu Chemical Co., Ltd., solid content: 100%).

(Preparation of Thermal Transfer Sheet O)

A thermal transfer sheet of Example O was obtained by carrying out the same procedure in the preparation of the thermal transfer sheet 10 except that 0.42 part of polyester modified polysiloxane compound (BYK310, manufactured by BYK-Chemie GmbH, solid content: 25%) in the respective liquids for forming yellow, magenta, and cyan dye layers 4 were replaced by 0.105 part of carbinol modified silicone oil (X-22-4015, manufactured by Shin-Etsu Chemical Co., Ltd., solid content: 100%).

(Preparation of Thermal Transfer Image-Receiving Sheet 1)

As the substrate sheet, RC paper (manufactured by Mitsubishi Paper Mills) was availed. On this substrate, a liquid for forming heat insulating layer having the following composition, and a liquid for foaming dye receiving layer 1 were heated to 40° C., respectively, and then coated so as to obtain a thickness of 12 μm, 3 μm, respectively, in the dried state in accordance with the slide coating method, undergone cooling at 5° C. for 30 seconds, and then dried at 50° C. for 2 minutes, in order to obtain a thermal transfer image-receiving sheet 1. Incidentally, the coating liquids of the following compositions were those which were diluted with pure water so as to have a total solid content of 15-30% individually.

<Liquid for Forming Heat Insulating Layer>

| | |
|---|---|
| Hollow particles (volume average particle diameter: 0.5 μm) (MH5055, manufactured by Japan Zeon Co., Inc.) | 70 parts |
| Gelatin (RR, manufactured by Nitta Gelatin Co., Ltd.) | 25 parts |
| Aqueous polyurethane resin (AP40, manufactured by DIC Corporation) | 5 parts |

<Liquid for Forming Dye-Receiving Layer 1>

| | |
|---|---|
| Vinyl chloride - vinyl acetate type emulsion (Vinyl chloride/vinyl acetate = 97.5/2.5, solid content 36%) | 411 parts |
| Aqueous dispersion of releasing agent (solid content: 17%) | 20 parts |
| Epoxy cross-linking agent (EX-512, manufactured by Nagase ChemteX Corporation, solid content: 100%) | 7.6 parts |
| Pure water (for dispersing the epoxy cross-linking agent) | 11.4 parts |
| Thickener (solid content: 30%) (Adekanol UH-526, manufactured by ADEKA Corporation) | 45 parts |
| Pure water (for dispersing the thickener) | 230 parts |
| Surfactant (aqueous solution of dioctyl sulfosuccinate sodium salt, solid content 20%) | 23 parts |

Herein, the above mentioned aqueous dispersion of the vinyl chloride-vinyl acetate type emulsion, and the above mentioned aqueous dispersion of the releasing agent were prepared as follows.

(Synthesis of Vinyl Chloride-Vinyl Acetate Type Emulsion)

Deionized water 600 g, a monomer mixture consisting of vinyl chloride monomer 438.8 g (97.5% by weight on the basis of the total amount of whole charged monomer) and vinyl acetate 11.2 g (2.5% by weight on the basis of the total amount of whole charged monomer), and potassium persulfate 2.25 g were charged into a 2.5 L autoclave. This reactive mixture was stirred by a stirring blade so as to maintain a rotation speed of 120 rpm, and the polymerization was initiated by raising temperature of the reaction mixture up to 60° C. A 5% by weight aqueous solution of sodium dodecyl benzene sulfonate 180 g (2% by weight on the basis of the total amount of whole charged monomer) were continuously added from the polymerization initiation to 4 hr after the initiation. When the polymerization system had a polymerization pressure drop of 0.6 MPa from the saturated vapor pressure of vinyl chloride monomer at 60° C., the polymerization was terminated, and the remaining monomer was recovered to obtain the vinyl chloride-vinyl acetate type emulsion.

(Preparation of Aqueous Dispersion of the Releasing Agent)

An epoxy modified silicone (X-22-3000T, manufactured by Shin-Etsu Chemical Co., Ltd.) 16 g and an aralkyl modified silicone (X-24-510, manufactured by Shin-Etsu Chemical Co., Ltd.) 8 g were dissolved in ethyl acetate 85 g. Then, triisopropyl naphthalene sulfonic acid sodium salt (solid content: 10%) 14 g was dissolved in pure water 110 g. After mixing and stirring the above two solutions, the resultant mixture underwent dispersing by using a homogenizer to prepare a dispersion. Thereafter, the ethyl acetate was removed under reduced pressure while heating the dispersion to 30-60° C. to obtain an aqueous dispersion of the silicone.

(Preparation of Thermal Transfer Image-Receiving Sheet 2)

A thermal transfer image-receiving sheet 2 was obtained by carrying out the same procedure for the thermal transfer image-receiving sheet 1 except that the liquid for forming dye-receiving layer 1 was replaced by a liquid for forming dye-receiving layer 2 having the following composition.

<Liquid for forming dye-receiving layer 2>

| | |
|---|---|
| Vinyl chloride type resin (Vinyblan 900, manufactured by Nissin Chemical Industry Co., Ltd.) | 100 parts |
| Polyether modified silicone (KF615A, manufactured by Shin-Etsu Chemical Co., Ltd.) | 1 part |
| Gelatin (RR, manufactured by Nitta Gelatin Co., Ltd.) | 10 parts |
| Surfactant (Surfynol 440, manufactured by Nissin Chemical Industry Co., Ltd.) | 0.5 parts |
| Water | 250 parts |

(Preparation of Thermal Transfer Image-Receiving Sheet 3)

A thermal transfer image-receiving sheet 3 was obtained by carrying out the same procedure for the thermal transfer image-receiving sheet 1 except that the liquid for forming dye-receiving layer 1 was replaced by a liquid for forming dye-receiving layer 3 having the following composition.

<Liquid for Forming Dye-Receiving Layer 3>

| | |
|---|---|
| Emulsion (as solid content) | 90 parts |
| Gelatin (as solid content) (RR, manufactured by Nitta Gelatin Co., Ltd.) | 10 parts |
| Polyether modified silicone (KF615A, manufactured by Shin-Etsu Chemical Co., Ltd.) | 2 part |
| Surfactant (Surfynol 440, manufactured by Nissin Chemical Industry Co., Ltd.) | 1 part |
| Water | 333 parts |

Herein, the above mentioned emulsion was prepared as follows.

Synthesis of Emulsion

Styrene 121 g, ethyl acrylate 77 g, and acrylic acid 2 g as comonomers for synthesizing copolymer, and Aqualon HS-10 (manufactured by Dai-ichi Kogyo Seiyaku Co., Ltd.) 1.9 g as emulsifier were added to 500 mL Erlenmeyer flask, and they were mixed with stirring (Hereinafter, this is referred to as monomer A). Into a 1 L three-necked flask, distilled water 200 g was added and then heated up to 80° C. Then, about 20% of the total amount of the monomer A was added thereto, and the obtained mixture was stirred for 10 minutes. Then, ammonium persulfate 0.4 g which was dissolved in pure water 20 g was added thereto, and the obtained mixture was stirred for 10 minutes. Thereafter, the remaining about 80% of the total amount of the monomer A was added dropwisely over 3 hours from a dropping funnel, which was followed by stirring for 3 hours. The reactant was cooled to room temperature, filtered through #150 mesh (manufactured by Japan Textile, Co., Ltd.), to obtain an emulsion (molecular weight: 240000, Tg.: 50° C.). From the molecular weights of styrene and ethyl acrylate, and the amounts thereof used in the reaction, the mol ratios of individual monomers were 40% and 60%.

(A Combination of the Thermal Transfer Sheet and the Thermal Transfer Image-Receiving Sheet in Examples and Comparative Examples)

Upon printing quality evaluation and storage stability evaluation, combinations of the thermal transfer sheet and the thermal transfer image-receiving sheet shown in Table 1 were provided as combinations of the thermal transfer sheet and the thermal transfer image-receiving sheet of Examples 1 to 28 and Comparative Examples 1 to 23, respectively.

| | Thermal transfer sheet | Thermal transfer image-receiving sheet |
|---|---|---|
| Example 1 | Thermal transfer sheet 1 | Thermal transfer image-receiving Sheet 1 |
| Example 2 | Thermal transfer sheet 2 | Thermal transfer image-receiving Sheet 1 |
| Example 3 | Thermal transfer sheet 2 | Thermal transfer image-receiving Sheet 2 |
| Example 4 | Thermal transfer sheet 2 | Thermal transfer image-receiving Sheet 3 |
| Example 5 | Thermal transfer sheet 3 | Thermal transfer image-receiving Sheet 1 |
| Example 6 | Thermal transfer sheet 4 | Thermal transfer image-receiving Sheet 1 |
| Example 7 | Thermal transfer sheet 5 | Thermal transfer image-receiving Sheet 1 |
| Example 8 | Thermal transfer sheet 6 | Thermal transfer image-receiving Sheet 1 |
| Example 9 | Thermal transfer sheet 7 | Thermal transfer image-receiving Sheet 1 |
| Example 10 | Thermal transfer sheet 7 | Thermal transfer image-receiving Sheet 2 |
| Example 11 | Thermal transfer sheet 7 | Thermal transfer image-receiving Sheet 3 |
| Example 12 | Thermal transfer sheet 8 | Thermal transfer image-receiving Sheet 1 |
| Example 13 | Thermal transfer sheet 9 | Thermal transfer image-receiving Sheet 2 |
| Example 14 | Thermal transfer sheet 10 | Thermal transfer image-receiving Sheet 2 |
| Example 15 | Thermal transfer sheet 10 | Thermal transfer image-receiving Sheet 3 |
| Example 16 | Thermal transfer sheet 11 | Thermal transfer image-receiving Sheet 2 |
| Example 17 | Thermal transfer sheet 11 | Thermal transfer image-receiving Sheet 3 |
| Example 18 | Thermal transfer sheet 12 | Thermal transfer image-receiving Sheet 2 |
| Example 19 | Thermal transfer sheet 13 | Thermal transfer image-receiving Sheet 1 |
| Example 20 | Thermal transfer sheet 13 | Thermal transfer image-receiving Sheet 2 |
| Example 21 | Thermal transfer sheet 13 | Thermal transfer image-receiving Sheet 3 |
| Example 22 | Thermal transfer sheet 14 | Thermal transfer image-receiving Sheet 2 |
| Example 23 | Thermal transfer sheet 15 | Thermal transfer image-receiving Sheet 2 |
| Example 24 | Thermal transfer sheet 16 | Thermal transfer image-receiving Sheet 2 |
| Example 25 | Thermal transfer sheet 17 | Thermal transfer image-receiving Sheet 2 |
| Example 26 | Thermal transfer sheet 18 | Thermal transfer image-receiving Sheet 2 |
| Example 27 | Thermal transfer sheet 19 | Thermal transfer image-receiving Sheet 2 |
| Example 28 | Thermal transfer sheet 20 | Thermal transfer image-receiving Sheet 2 |

-continued

| | Thermal transfer sheet | Thermal transfer image-receiving sheet |
|---|---|---|
| Comparative Example 1 | Thermal transfer sheet A | Thermal transfer image-receiving Sheet 1 |
| Comparative Example 2 | Thermal transfer sheet B | Thermal transfer image-receiving Sheet 1 |
| Comparative Example 3 | Thermal transfer sheet B | Thermal transfer image-receiving Sheet 2 |
| Comparative Example 4 | Thermal transfer sheet B | Thermal transfer image-receiving Sheet 3 |
| Comparative Example 5 | Thermal transfer sheet C | Thermal transfer image-receiving Sheet 1 |
| Comparative Example 6 | Thermal transfer sheet C | Thermal transfer image-receiving Sheet 2 |
| Comparative Example 7 | Thermal transfer sheet C | Thermal transfer image-receiving Sheet 3 |
| Comparative Example 8 | Thermal transfer sheet D | Thermal transfer image-receiving Sheet 1 |
| Comparative Example 9 | Thermal transfer sheet E | Thermal transfer image-receiving Sheet 1 |
| Comparative Example 10 | Thermal transfer sheet F | Thermal transfer image-receiving Sheet 1 |
| Comparative Example 11 | Thermal transfer sheet G | Thermal transfer image-receiving Sheet 2 |
| Comparative Example 12 | Thermal transfer sheet H | Thermal transfer image-receiving Sheet 2 |
| Comparative Example 13 | Thermal transfer sheet I | Thermal transfer image-receiving Sheet 2 |
| Comparative Example 14 | Thermal transfer sheet I | Thermal transfer image-receiving Sheet 3 |
| Comparative Example 15 | Thermal transfer sheet J | Thermal transfer image-receiving Sheet 2 |
| Comparative Example 16 | Thermal transfer sheet K | Thermal transfer image-receiving Sheet 1 |
| Comparative Example 17 | Thermal transfer sheet K | Thermal transfer image-receiving Sheet 2 |
| Comparative Example 18 | Thermal transfer sheet K | Thermal transfer image-receiving Sheet 3 |
| Comparative Example 19 | Thermal transfer sheet L | Thermal transfer image-receiving Sheet 2 |
| Comparative Example 20 | Thermal transfer sheet M | Thermal transfer image-receiving Sheet 2 |
| Comparative Example 21 | Thermal transfer sheet M | Thermal transfer image-receiving Sheet 3 |
| Comparative Example 22 | Thermal transfer sheet N | Thermal transfer image-receiving Sheet 2 |
| Comparative Example 23 | Thermal transfer sheet O | Thermal transfer image-receiving Sheet 2 |

(Evaluation for Printing Quality)

In accordance with the combinations of the thermal transfer sheets and the thermal transfer image-receiving sheets shown in Table 1, vertical stripe image (2 cm in width of black solid image (255/255 gray scale), and gray image (180/255 gray scale)) were printed by a sublimation type thermal transfer printer (manufactured by ALTECH ADS Co., Ltd, type no.: CW-01) at a recording speed of 6.5 cm/s to obtain printed matters of Examples 1 to 28 and Comparative Examples 1 to 23. The obtained printings were observed visually whether peeling-off mark exists on the printed matter or not, and were evaluated for the printing quality according to the following criteria. The evaluation results were shown in Table 2. Here, with respect to the recording speed, the time required for from start to finish a printing in the case of performing a yellow printing on a printed matter of the postcard size was measured, and based on the measured time, the value is converted into data per second.

"Evaluation criteria"

○: no peeling-off mark was observed.

Δ: peeling-off mark was slightly observed on the printed matter.

X: peeling-off mark was observed on the printed matter.

(Evaluation for Storage Ability)

Each magenta dye layer of the thermal transfer sheet and each back face layer, which were used in the combinations of Examples 1-28, and Comparative Example 1-23, were faced each other, and a load of 20 kg/cm$^2$ was applied thereto, followed by storage under an environment of a temperature of 40° C. and a humidity of 90% for 96 hrs to transfer (kick) the dye in the dye layer to the back face layer side. Then, Each back face layer interested was allowed to face the protective layer of the transcriptive protective layer, and a load of 20 kg/cm$^2$ was applied thereto, followed by storage under an environment of a temperature of 50° C. and a humidity of 20% for 24 hr. Thereafter, the transcriptive protective layer on which the dye in the back face layer had been transferred (backed) was placed on an image receiving surface of an image receiving paper (color ink/paper set KP-361P, manufactured by Canon Inc.), and transfer was carried out under conditions of 110° C., and 4 mm/sec with a laminate tester (Lamipacker LPD2305PRO, manufactured by Fujipla Inc.). The substrate sheet was separated from the image receiving paper, and the hue of the transferred portion was measured with GRETAGSpectrolino (light source D65, view angle) 2°, manufactured by Gretag. Color difference (ΔE*) was calculated by the following equation, and the results were evaluated according to the following criteria. Incidentally, the transcriptive protective layer used herein was prepared in accordance with the procedure described below.

$$\Delta E^* = ((\text{difference in } L^* \text{ value between before facing and after facing})^2 + (\text{difference in } a^* \text{ value between before facing and after facing})^2 + (\text{difference in } b^* \text{ value between before facing and after facing})^2)^{1/2}$$

The coating liquid for forming delamination layer having the following composition was coated onto a surface of the substrate which was opposite to the surface side that the back face layer was provided, at a coating rate of 1 g/m$^2$ on the solid content basis, and then the coated liquid was dried to form a delamination layer. Then, onto the delamination layer, the coating liquid for forming primer layer having the following composition was coated so as to obtain a coated amount of 0.10 g/m$^2$ in the dried state, and the coated liquid was dried to form a primer layer. Subsequently, a coating liquid for forming protective layer having the following composition was coated on the primer layer at a coating rate of 1.5 g/m$^2$ on the solid content basis, and then the coated liquid was dried in order to form the transcriptive protective layer.

<Liquid for Forming Delamination Layer>

| | |
|---|---|
| Acrylic resin (DIANAL BR-87, manufactured by Mitsubishi Rayon Co., Ltd.) | 20 parts |
| Toluene | 40 parts |
| Methyl ethyl ketone | 40 parts |

<Liquid for Forming Primer Layer>

| | |
|---|---|
| Colloidal silica (particle diameter: 4-6 nm, solid content: 10%) (Snowtex OXS, manufactured by Nissan Chemical Industries Ltd.) | 30 parts |
| Polyvinyl pyrrolidone resin (K-90, manufactured by ISP) | 3 parts |
| Water | 50 parts |
| Isopropyl alcohol | 17 parts |

<Liquid for Forming Protective Layer>

| | |
|---|---|
| Acrylic resin (DIANAL BR-87, manufactured by Mitsubishi Rayon Co., Ltd.) | 69.6 parts |
| Acrylic copolymer which was reactively linked with a reactive UV-Ray absorber (UVA635L, manufactured by BASF Japan Ltd.) | 17.4 parts |
| Silica (Sylysia 310, manufactured by FUJI Silysia Chemical Ltd.) | 25 parts |
| Methyl ethyl ketone | 100 parts |
| Toluene | 100 parts |

"Evaluation Criteria"

○: Color difference ΔE* between transferred product in which unstored protective layer had been transferred and transferred product in which backed protective layer transfer body had been transferred was less than 2.0.

Δ: Color difference ΔE* between transferred product in which unstored protective layer had been transferred and transferred product in which backed protective layer transfer body had been transferred was not less than 2.0 and less than 3.0.

X: Color difference ΔE* between transferred product in which unstored protective layer had been transferred and transferred product in which backed protective layer transfer body had been transferred was not less than 3.0.

TABLE 2

| | Evaluation for printing quality | Evaluation for preservation |
|---|---|---|
| Example 1 | ○ | ○ |
| Example 2 | ○ | ○ |
| Example 3 | ○ | ○ |
| Example 4 | ○ | ○ |
| Example 5 | ○ | ○ |
| Example 6 | ○ | ○ |
| Example 7 | ○ | ○ |
| Example 8 | ○ | Δ |
| Example 9 | ○ | ○ |
| Example 10 | ○ | ○ |
| Example 11 | ○ | ○ |
| Example 12 | ○ | ○ |
| Example 13 | ○ | ○ |
| Example 14 | ○ | ○ |
| Example 15 | ○ | ○ |
| Example 16 | ○ | ○ |
| Example 17 | ○ | ○ |
| Example 18 | ○ | ○ |
| Example 19 | ○ | ○ |
| Example 20 | ○ | ○ |
| Example 21 | ○ | ○ |
| Example 22 | ○ | ○ |
| Example 23 | ○ | ○ |
| Example 24 | Δ | ○ |
| Example 25 | ○ | Δ |
| Example 26 | ○ | ○ |
| Example 27 | ○ | ○ |
| Example 28 | ○ | ○ |
| Comparative Example 1 | X | ○ |
| Comparative Example 2 | X | ○ |
| Comparative Example 3 | X | ○ |
| Comparative Example 4 | X | ○ |
| Comparative Example 5 | X | ○ |
| Comparative Example 6 | X | ○ |
| Comparative Example 7 | X | ○ |
| Comparative Example 8 | X | Δ |
| Comparative Example 9 | X | ○ |
| Comparative Example 10 | Δ | X |
| Comparative Example 11 | X | ○ |
| Comparative Example 12 | X | ○ |
| Comparative Example 13 | X | ○ |
| Comparative Example 14 | X | ○ |
| Comparative Example 15 | X | Δ |
| Comparative Example 16 | X | ○ |
| Comparative Example 17 | X | ○ |
| Comparative Example 18 | X | ○ |
| Comparative Example 19 | Δ | X |
| Comparative Example 20 | X | ○ |
| Comparative Example 21 | X | ○ |
| Comparative Example 22 | X | ○ |
| Comparative Example 23 | Δ | X |

EXPLANATION OF NUMERIC SYMBOLS

10 . . . Thermal transfer sheet
30 . . . Thermal transfer image-receiving sheet
1 . . . Substrate
2 . . . Dye layer
3 . . . Undercoat layer
4 . . . Back face layer
21 . . . Another substrate
22 . . . Dye receiving layer

The invention claimed is:

1. An image forming method in which an image is formed by using a thermal transfer sheet and a thermal transfer image-receiving sheet in combination, wherein the thermal transfer sheet comprises a substrate, a dye layer formed on one surface of the substrate and a back face layer formed on another surface of the substrate, wherein the thermal transfer image-receiving sheet comprises another substrate and a dye-receiving layer formed on one surface of the other substrate, which is characterized in that the dye layer of the thermal transfer sheet comprises a sublimation type dye, a binder resin, and (A) a polyether modified silicone having a viscosity of not less than 1000 $mm^2/s$ at 25° C.; and the dye-receiving layer of the thermal transfer image-receiving sheet comprises an aqueous dye-receiving layer.

2. The image forming method according to claim 1, wherein the dye layer comprises a polyvinyl acetal resin or a polyvinyl butyral resin.

3. The image forming method according to claim 2, wherein (A) the polyether modified silicone having a viscosity of not less than 1000 $mm^2/s$ at 25° C. is contained at an amount range of not less than 0.5% by weight and not more than 5% by weight on the basis of the total solid content weight of the binder resin in the dye layer.

4. The image forming method according to claim 2, wherein the aqueous dye-receiving layer is a dye-receiving layer containing a water-soluble resin or water-soluble polymer, or a dye-receiving layer formed by using a coating liquid containing an aqueous resin.

5. The image forming method according to claim 1, wherein (A) the polyether modified silicone having a viscosity of not less than 1000 $mm^2/s$ at 25° C. is contained at an amount range of not less than 0.5% by weight and not more than 5% by weight on the basis of the total solid content weight of the binder resin in the dye layer.

6. The image forming method according to claim 5, wherein the aqueous dye-receiving layer is a dye-receiving layer containing a water-soluble resin or water-soluble polymer, or a dye-receiving layer formed by using a coating liquid containing an aqueous resin.

7. The image forming method according to claim 1, wherein the aqueous dye-receiving layer is a dye-receiving layer containing a water-soluble resin or water-soluble polymer, or a dye-receiving layer formed by using a coating liquid containing an aqueous resin.

8. The image forming method according to claim 1, wherein the dye layer further comprises (B) a polyester modified polysiloxane.

9. The image forming method according to claim 1, wherein the dye layer further comprises (B) a polyester modified polysiloxane, and (A) the polyether modified silicone having a viscosity of not less than 1000 mm2/s at 25° C., and (B) the polyester modified polysiloxane are contained at an total amount thereof of not less than 0.5% by weight and not more than 5% by weight on the basis of the total solid content weight of the binder resin in the dye layer.

10. A combination of a thermal transfer sheet and a thermal transfer image-receiving sheet, which is characterized in that the thermal transfer sheet comprises a substrate, a dye layer formed on one surface of the substrate and a back face layer formed on another surface of the substrate, wherein the dye layer comprises a sublimation type dye, a binder resin, and (A) a polyether modified silicone having a viscosity of not less than 1000 $mm^2/s$ at 25° C.; and the thermal transfer image-receiving sheet comprises another substrate and a dye-receiving layer formed on one surface of the other substrate.

* * * * *